US008960976B2

(12) United States Patent
Georgitsis et al.

(10) Patent No.: US 8,960,976 B2
(45) Date of Patent: Feb. 24, 2015

(54) MOUNTING APPARATUS FOR ADJUSTABLY POSITIONING A LIGHTING DEVICE

(71) Applicants: Anthony C. Georgitsis, Edgewood, WA (US); Joseph Biro, Scottsdale, AZ (US); Nicholas B. Irwin, Auburn, WA (US)

(72) Inventors: Anthony C. Georgitsis, Edgewood, WA (US); Joseph Biro, Scottsdale, AZ (US); Nicholas B. Irwin, Auburn, WA (US)

(73) Assignee: Vision Motor Sports, Inc., Algona, WA (US)

( * ) Notice: Subject to any disclaimer, the term of this patent is extended or adjusted under 35 U.S.C. 154(b) by 0 days.

(21) Appl. No.: 13/693,170

(22) Filed: Dec. 4, 2012

(65) Prior Publication Data

US 2014/0153267 A1 Jun. 5, 2014

(51) Int. Cl.

| | |
|---|---|
| ***F21S 8/08*** | (2006.01) |
| ***F21V 21/30*** | (2006.01) |
| ***F21V 29/00*** | (2006.01) |
| *F21Y 101/02* | (2006.01) |

(52) U.S. Cl.

CPC ..... *F21V 21/30* (2013.01); *F21V 29/225* (2013.01); *F21Y 2101/02* (2013.01)

USPC ..... 362/419; 362/417; 362/426; 362/427

(58) Field of Classification Search

USPC ..... 362/362, 368–371, 382, 390, 418, 427

See application file for complete search history.

(56) References Cited

U.S. PATENT DOCUMENTS

| | | | | | |
|---|---|---|---|---|---|
| 2,241,059 | A | * | 5/1941 | Foulds | 248/542 |
| 3,505,515 | A | * | 4/1970 | Adra | 362/371 |
| 4,410,933 | A | * | 10/1983 | Blake et al. | 362/371 |
| 5,967,640 | A | * | 10/1999 | Moriyama et al. | 362/147 |
| 2010/0157602 | A1 | * | 6/2010 | Nichols | 362/277 |
| 2011/0051410 | A1 | | 3/2011 | Liang | |
| 2011/0074313 | A1 | | 3/2011 | Gordin | |

FOREIGN PATENT DOCUMENTS

| | | |
|---|---|---|
| EP | 2056020 | 5/2009 |
| KR | 20-0238537 | 10/2001 |
| KR | 20-0404335 | 12/2005 |

OTHER PUBLICATIONS

International Search Report & Written Opinion of PCT/US2013/031175 dated Aug. 26, 2013.

* cited by examiner

*Primary Examiner* — Donald Raleigh

(74) *Attorney, Agent, or Firm* — Barnes & Thornburg LLP; Mark J. Nahnsen

(57) ABSTRACT

A mounting apparatus for adjustably positioning a lighting device. The mounting apparatus includes a mounting bracket having an ear and a first indicator associated with the ear. The mounting apparatus also includes a second indicator adapted to be coupled to the lighting device for conjoint rotational movement about a rotational axis with respect to the mounting bracket. The second indicator and the lighting device may be selectively rotated about the rotational axis such that the second indicator is located in a desired position with respect to the first indicator whereby the lighting device is located in a desired measured orientation with respect to the mounting bracket.

24 Claims, 30 Drawing Sheets

MOUNTING APPARATUS FOR ADJUSTABLY POSITIONING A LIGHTING DEVICE

BACKGROUND

The present disclosure is directed to a mounting apparatus for adjustably positioning a lighting device, in particular to a mounting apparatus including a first indicator and a second indicator. The second indicator and the lighting device are conjointly rotatably with respect to the first indicator such that the lighting device may be selectively rotated to a designated selected position with respect to the first indicator whereby the lighting device is located in a desired measured orientation with respect to the first indicator.

DESCRIPTION OF THE DRAWING FIGURES

DETAILED DESCRIPTION

Figure 1:
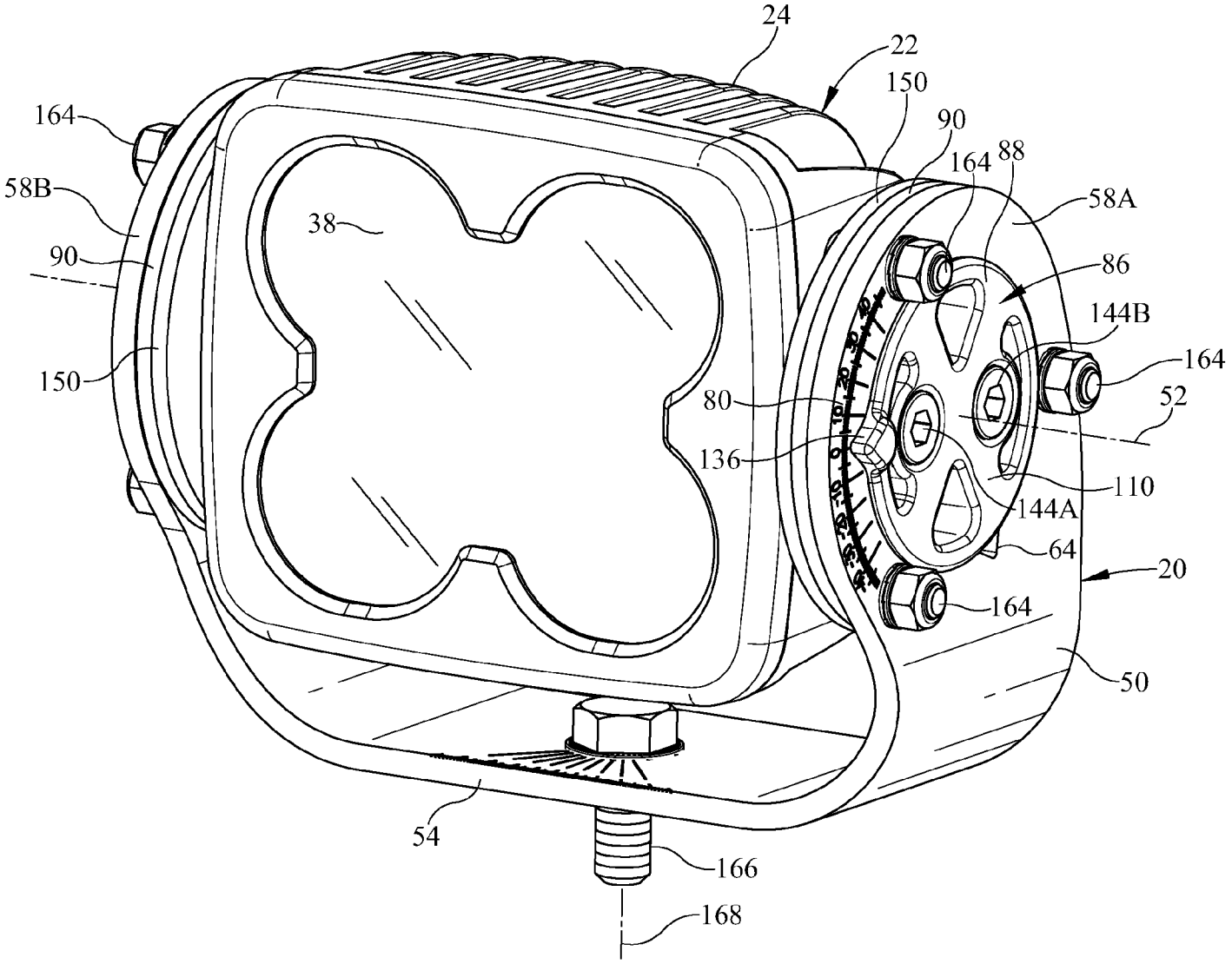
FIG. 1 is a perspective view of a mounting apparatus of the present disclosure shown with a lighting device rotationally coupled to a mounting bracket of the mounting apparatus.

The present disclosure relates to a mounting apparatus for selectively and adjustably positioning a lighting device. An embodiment of the mounting apparatus is shown in FIGS. 1 to 13 as mounting apparatus 20. Mounting apparatus 20 is adapted to be removably attached to a lighting device 22. Lighting device 22 includes a housing 24 having a side wall 26 and a spaced apart and generally parallel side wall 28. Housing 24 also includes a bottom wall 30 that extends between bottom edges of side walls 26 and 28 and a top wall 32 that is spaced apart and generally parallel to bottom wall 30 and that extends between top ends of side walls 26 and 28. Housing 24 also includes a rear wall 34 that is spaced apart and generally parallel from a front wall 36. Rear wall 34 and front wall 36 are attached to opposite edges of side walls 26 and 28, bottom wall 30 and top wall 32. Front wall 36 includes a lens 38 formed from a substantially clear or translucent material. Housing 24 includes a chamber in which one or more light emitting devices, for example, light bulbs or light emitting diodes (LEDs) are disposed. Light emitted from the light emitting devices is projected through the lens 38 of the lighting device 22 and onto a surface or object to provide illumination of the surface or object. Side wall 26 and side wall 28 each include a generally planar mounting base 40. The mounting bases 40 are generally parallel to and spaced apart from one another. Each mounting base 40 includes a threaded aperture 42A and a generally parallel and spaced apart threaded aperture 42B.

Figure 2:
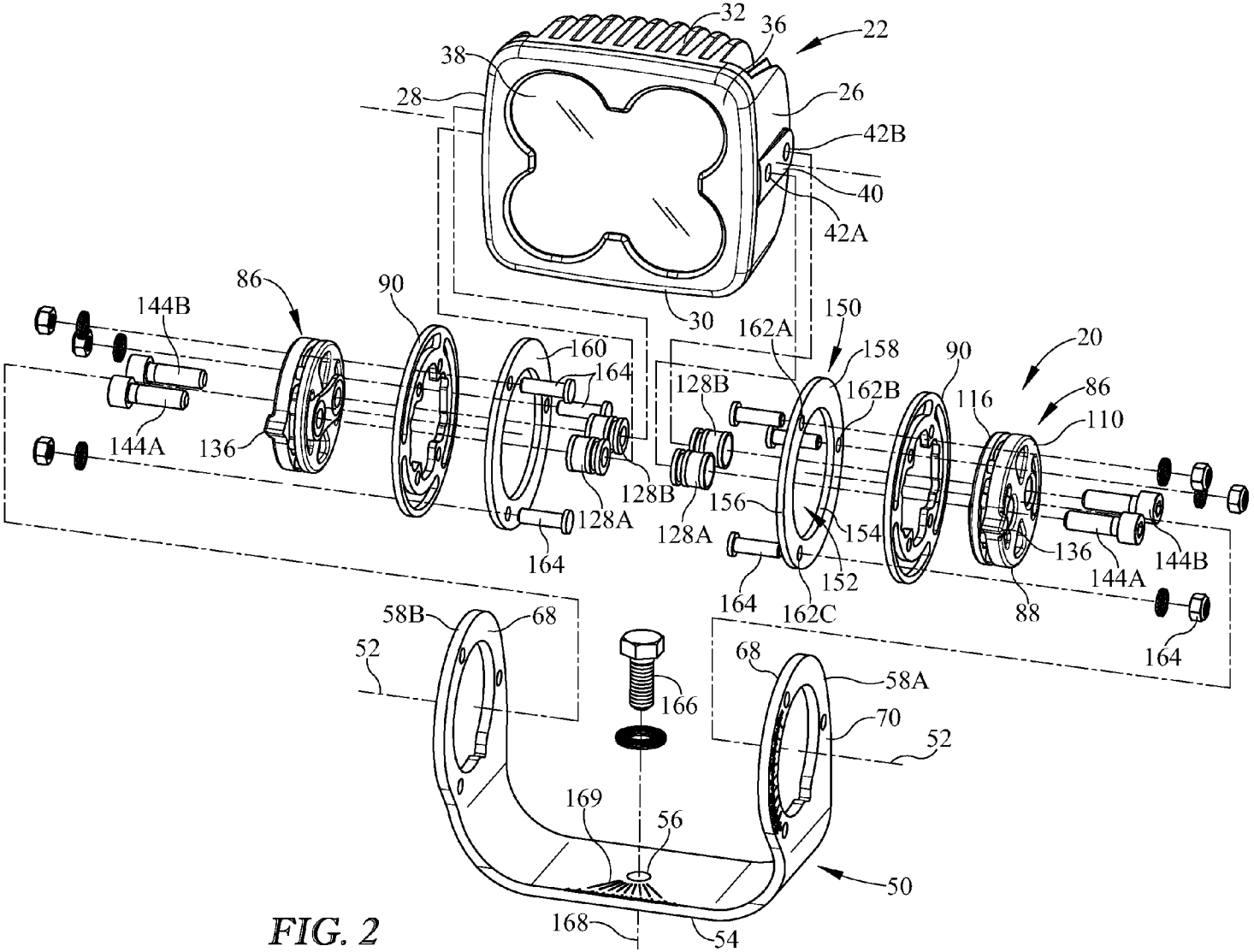
FIG. 2 is an exploded view of the mounting apparatus and lighting device of FIG. 1.
Figure 13:
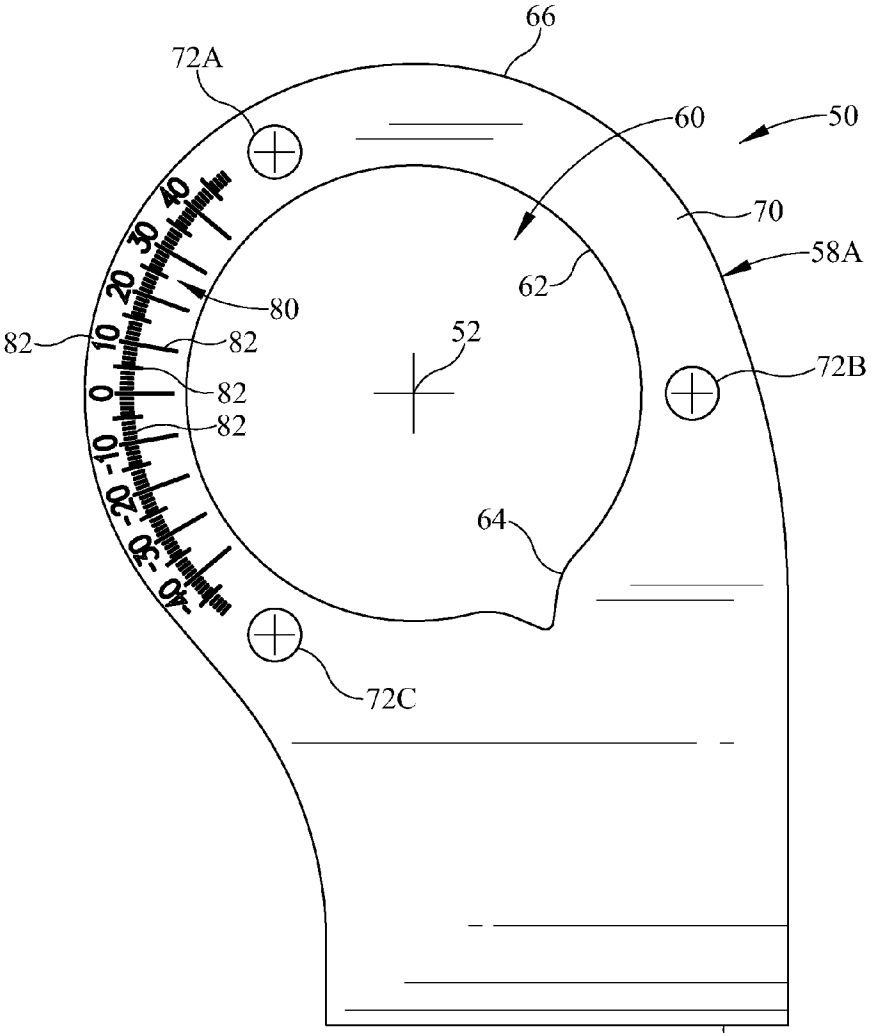
FIG. 13 is a side elevational view of the mounting bracket of the mounting assembly.

Mounting apparatus 20 includes a mounting bracket 50, as shown in FIG. 1. Lighting device 22 is adapted to be removably and rotationally coupled to mounting bracket 50 for selective rotation about a rotational axis 52 with respect to mounting bracket 50. Mounting bracket 50 includes a generally planar base 54 having a central aperture 56, as shown in FIG. 2. Mounting bracket 50 also includes ears 58A and 58B that are attached to opposite ends of base 54 and that are generally parallel to and spaced apart from one another. Each ear 58A and B includes a generally circular aperture 60, as shown in FIG. 13. Apertures 60 are coaxially aligned with one another such that the central axes of apertures 60 are coaxially aligned with rotational axis 52. Each aperture 60 forms a generally circular rim 62 as shown in FIG. 13. Rim 62 includes a generally V-shaped notch 64 that extends generally radially outwardly from rotational axis 52. Notch 64 is in communication with aperture 60. Each ear 58A and B also includes a peripheral outer edge 66, a generally planar interior surface 68 and a generally parallel and spaced apart planar exterior surface 70. Each ear 58A and B also includes one or more circular peripheral apertures, such as peripheral apertures 72A-C. Peripheral apertures 72A-C are located radially outwardly from aperture 60 with respect to rotational axis 52 and between rim 62 and outer edge 66. Peripheral apertures 72A-C are spaced generally equidistantly apart from one another about rotational axis 52. As shown in FIG. 13, peripheral apertures 72A-C are spaced apart from one another at an angle approximate 120 degrees with respect to rotational axis 52. Mounting bracket 50 may be made from metal, such as stainless steel. Alternatively, mounting bracket 50 may only include a single ear, if desired.

A respective first indicator 80 is associated with each ear 58A and B and may be coupled to or formed on exterior surface 70 of each ear 58A and B. First indicator 80 may comprise a graduated scale including a plurality of visual indicia 82 such a plurality of markings. For example, the visual indicia 82 may comprise a plurality of spaced apart lines arranged radially with respect to rotational axis 52 and spaced apart from one another such as to represent various degrees of rotation about and with respect to rotational axis 52. As shown in FIG. 13, the visual indicia 82 may also include numerical indicia indicating respective amounts or degrees of rotation about rotational axis 52 and with respect to ear 58A and mounting bracket 50. Indicia 82 of first indicator 80 are located between rim 62 and outer edge 66 and on exterior surface 70 of each ear 58A and B.

Figure 7:
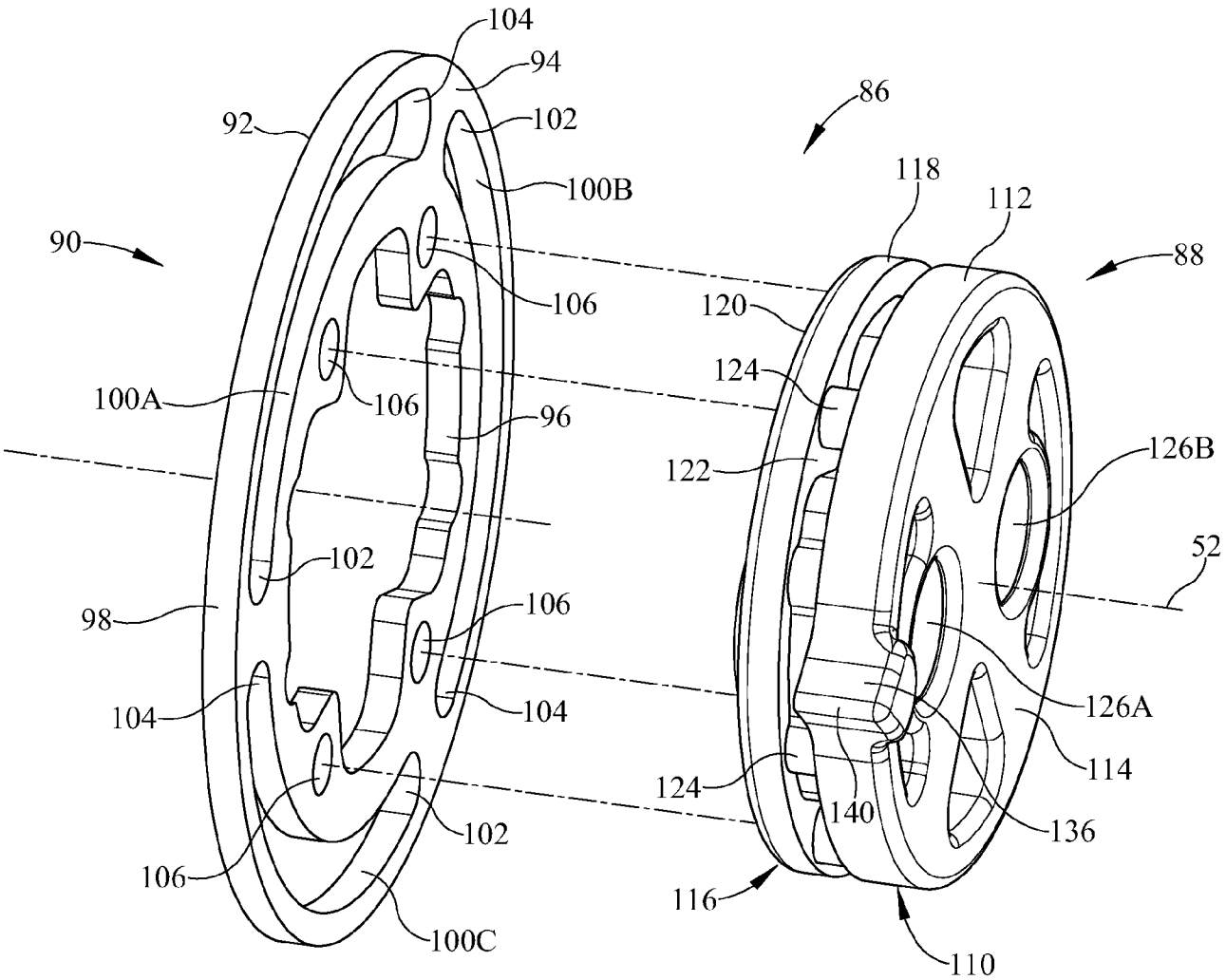
FIG. 7 is an exploded view of the trunnion of the mounting apparatus showing the hub and flange of the trunnion.
Figure 8:
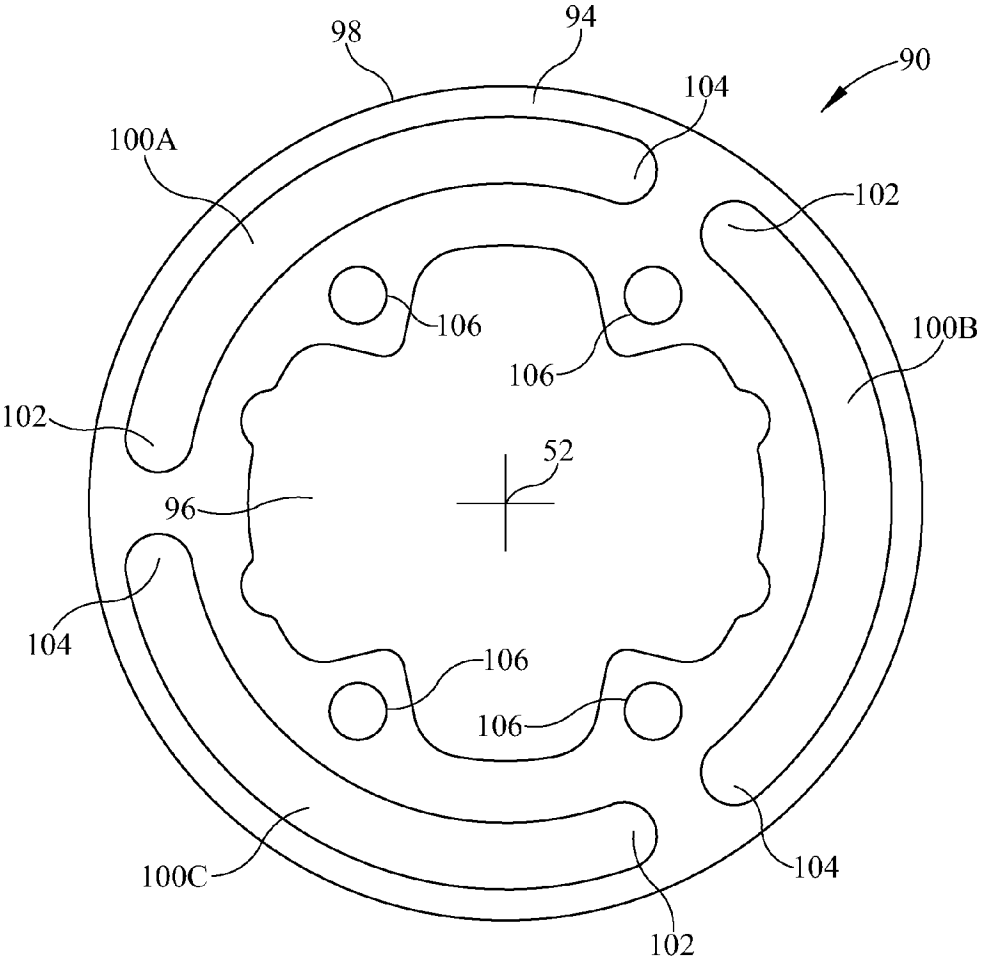
FIG. 8 is a front elevational view of the flange of the trunnion.
Figure 9:
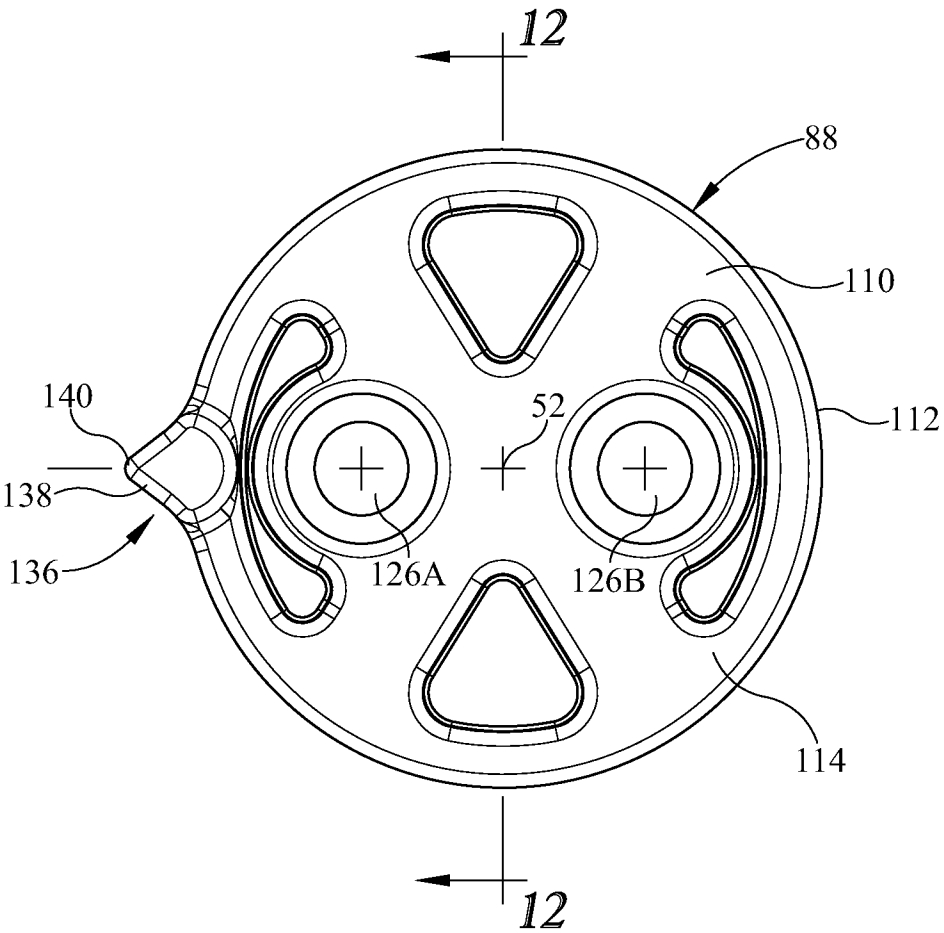
FIG. 9 is a front elevational view of the hub of the trunnion.

Mounting apparatus 20 also includes a trunnion 86 that is rotationally coupled to ear 58A and a trunnion 86 that is rotationally coupled to ear 58B, as shown in FIG. 2. Each trunnion 86 includes a generally cylindrical hub 88 formed from an elastomeric material such as rubber or another vibration absorbing material. Trunnion 86 also includes a flange 90, made from a metal such as stainless steel, that extends radially outwardly from and peripherally around hub 88. Trunnion 86 can be formed by molding hub 88 with flange 90. Flange 90 is generally circular and plate-like having a generally planar interior surface 92 and a generally planar exterior surface 94 spaced apart from and generally parallel to interior surface 92, as shown in FIG. 7. Flange 90 includes a central aperture 96 and an outer generally circular peripheral rim 98. Central aperture 96 includes an axis that is adapted to be located generally coaxially with rotational axis 52. Flange 90 also includes one or more elongate generally curved arcuate slots, such as slots 100A-C. Each slot 100A-C extends in a generally circular manner about axis 52 between a first end 102 and a second end 104. Slots 100A-C extend through flange 90 from interior surface 92 to exterior surface 94. Flange 90 also includes one or more generally circular apertures 106 that are equally spaced about rotational axis 52 and that extend from interior surface 92 to exterior surface 94.

Hub 88 of trunnion 86 includes a first generally cylindrical boss 110 having a generally circular rim 112 and an exterior surface 114, as shown in FIG. 7 and is preferably molded onto flange 90. Hub 88 also includes a second boss 116 having a generally circular rim 118 and an exterior surface 120. A peripheral groove 122 extends peripherally around hub 88 and between interior surfaces of first boss 110 and second boss 116. A plurality of posts 124 are located within groove 122 and extend between interior surfaces of first boss 110 and second boss 116. Hub 88 extends through aperture 96 of flange 90 with flange 90 located within groove 122 of hub 88. Posts 124 of hub 88 extend respectively through apertures 106 of flange 90 such that hub 88 and flange 90 are coupled to one another for conjoint rotation about rotational axis 52. First boss 110 extends outwardly from exterior surface 94 of flange 90 along rotational axis 52 and second boss 116 extends outwardly from interior surface 92 of flange 90 along rotational axis 52. Slots 100A-C of flange 90 are located radially outwardly from rims 112 and 118 of first and second bosses 110 and 116.

Figure 11:
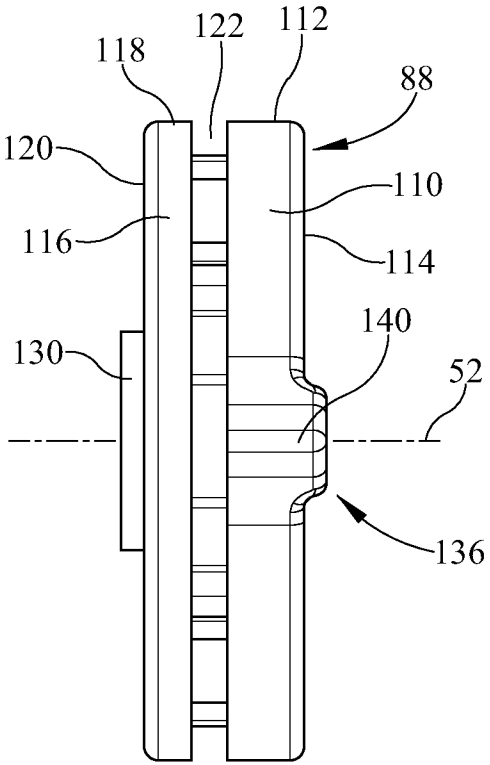
FIG. 11 is a side elevational view of the hub of the trunnion.
Figure 12:
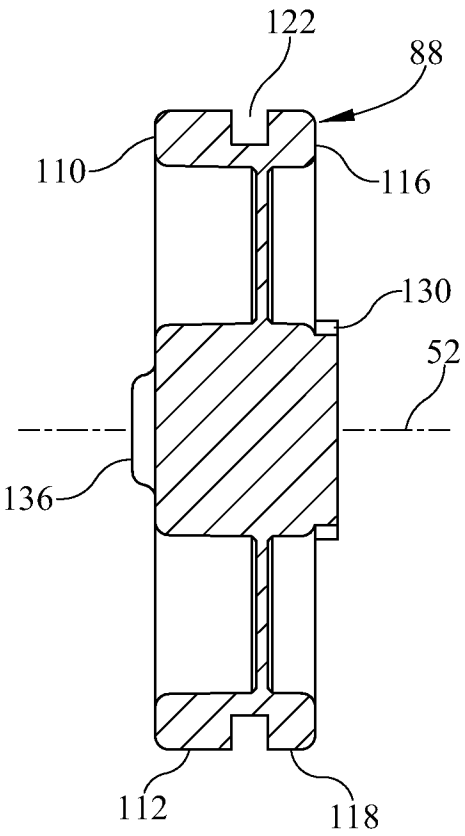
FIG. 12 is cross sectional view of the hub of the trunnion taken along line 12-12 of FIG. 9.

Hub 88 also includes generally circular apertures 126A and 126B that extend from exterior surface 114 of first boss 110 to exterior surface 120 of second boss 116 and that extend through aperture 96 of flange 90, as shown in FIG. 7. Each aperture 126A-B is adapted to receive a respective generally cylindrical bushing 128A-B, as shown in FIG. 2. Bushings 128A-B may be made from metal material such as aluminum. Each bushing 128A-B includes a cylindrical aperture and extends from exterior surface 114 of first boss 110 to exterior surface 120 of second boss 116. The central axes of the aperture in bushing 128A and aperture 126A of hub 88 are adapted to be coaxially aligned with the central axis of aperture 42A of lighting device 22. The central axes of the aperture in bushing 128B and aperture 126B of hub 88 are adapted to be coaxially aligned with the central axis of aperture 42B of lighting device 22. Second boss 116 includes a pad 130 that projects outwardly from exterior surface 114, as shown in FIG. 11. The apertures of bushings 128A-B extend through pad 130. Pad 130 is adapted to be located adjacent to and in engagement with mounting base 40 of lighting device 22. A plurality of generally triangular-shaped apertures and a plurality of generally arcuately curved slotted apertures extend through hub 88 generally parallel to rotational axis 52. Hub 88 is adapted to prevent or inhibit the transmission of vibrations from mounting bracket 50 and flange 90 to lighting device 22.

Figure 10:
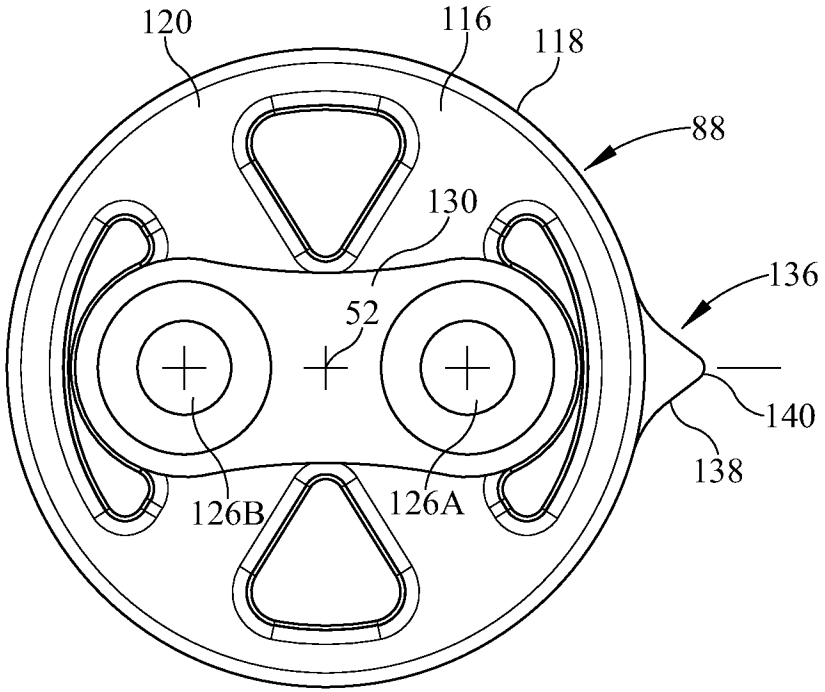
FIG. 10 is a rear elevational view of the hub of the trunnion.

Trunnion 86 also includes a second indicator 136 coupled to first boss 110 of hub 88, as shown in FIG. 10. Second indicator 136 may be in the form of a generally triangular-shaped pointer 138 having a tip 140. Second indicator 136 extends radially outwardly from rim 112 of first boss 110 generally radially with respect to rotational axis 52. Second indicator 136 is conjointly rotatable with flange 90 and hub 88 about rotational axis 52 with respect to mounting bracket 50.

First boss 110 of hub 88 is inserted through aperture 60 of ear 58A with second indicator 136 aligned with notch 64 in rim 62 of aperture 60, until exterior surface 94 of flange 90 is located adjacent interior surface 68 of ear 58A, as shown in FIG. 2. Rim 112 of first boss 110 fits closely within rim 62 of aperture 60 in ear 58A such that trunnion 86 and second indicator 136 may be rotated about rotational axis 52 with respect to ear 58A and mounting bracket 50. Trunnion 86 is rotated about axis 52 from its original insertion position, such that tip 140 of second indicator 136 overlies exterior surface 70 of ear 58A and may be located adjacent to or overlying first indicator 80. Fasteners 144A and B extend respectively through the apertures of bushings 128A and B and are removably inserted into apertures 42A and B of lighting device 22 to thereby removably attach lighting device 22 to hub 88 such that lighting device 22 is conjointly rotatable with trunnion 86 about rotational axis 52 with respect to mounting bracket 50. Fasteners 144A and B may comprise threaded fasteners such as bolts or the like.

Figure 3:
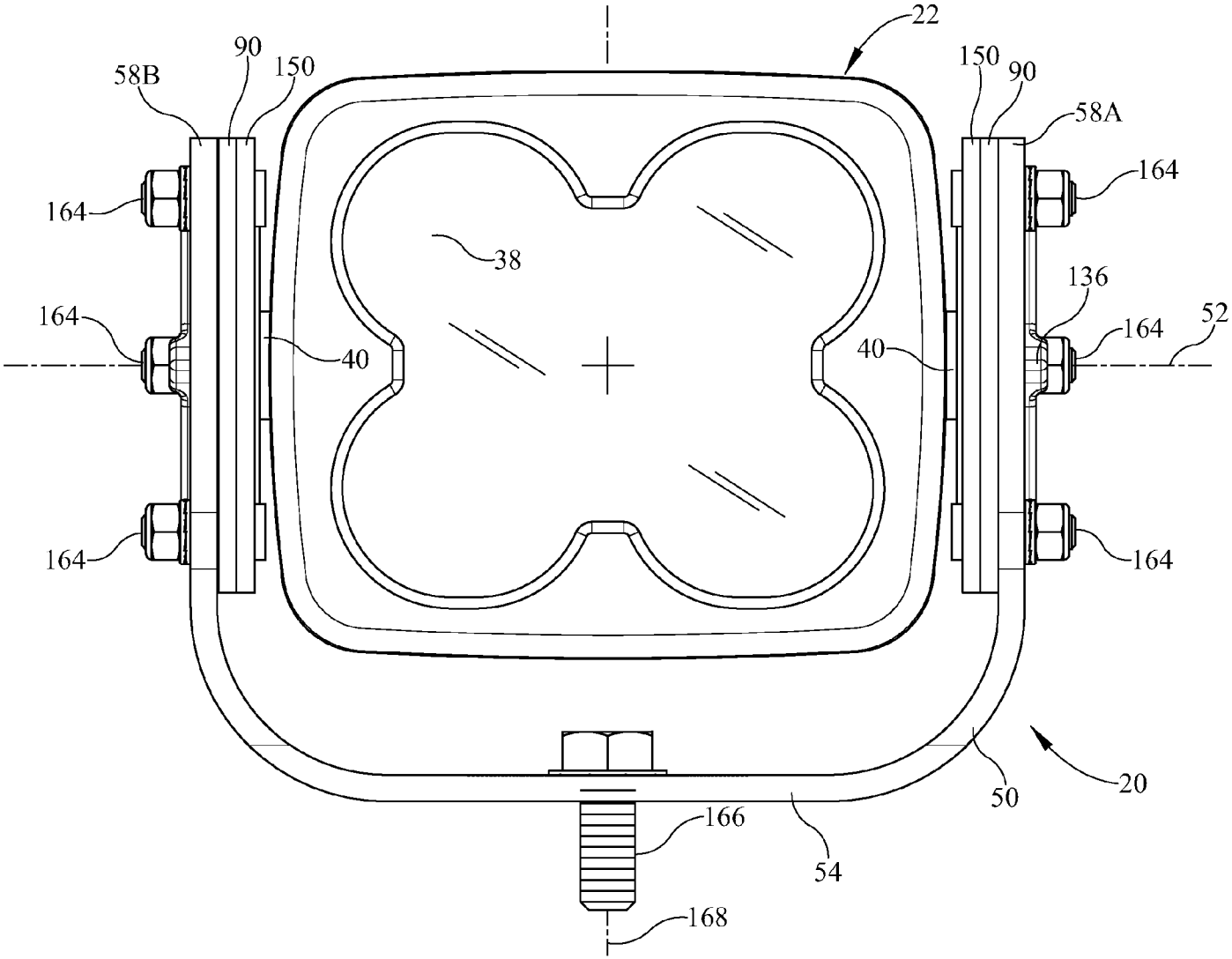
FIG. 3 is a front elevational view of the mounting apparatus and lighting device.
Figure 4:
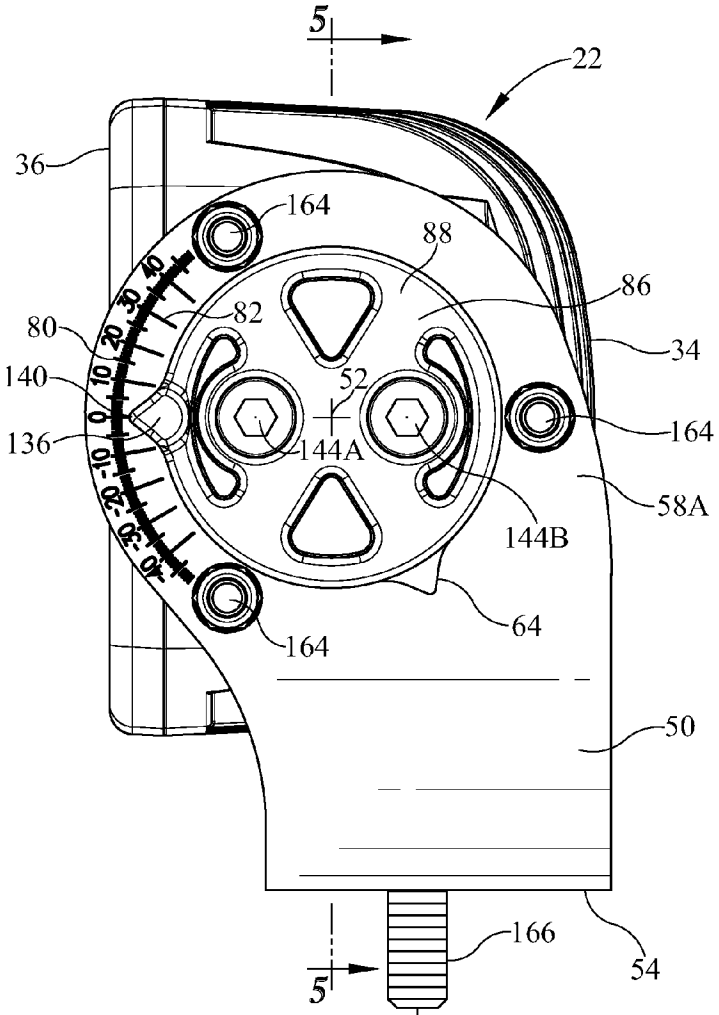
FIG. 4 is a side elevational view of the mounting apparatus and lighting device.
Figure 5:
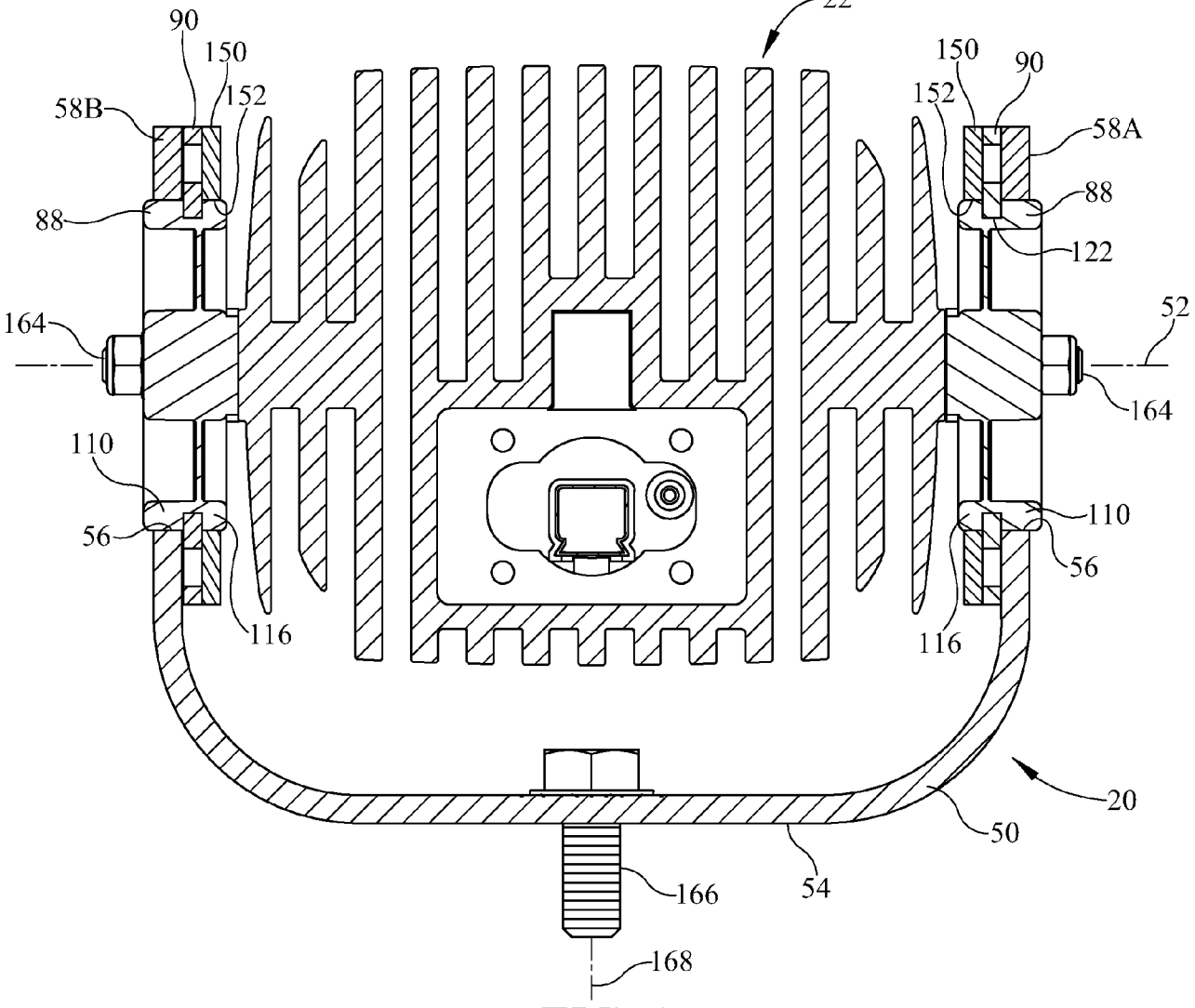
FIG. 5 is a cross sectional view of the mounting apparatus and lighting device taken along line 5-5 of FIG. 4.
Figure 6:
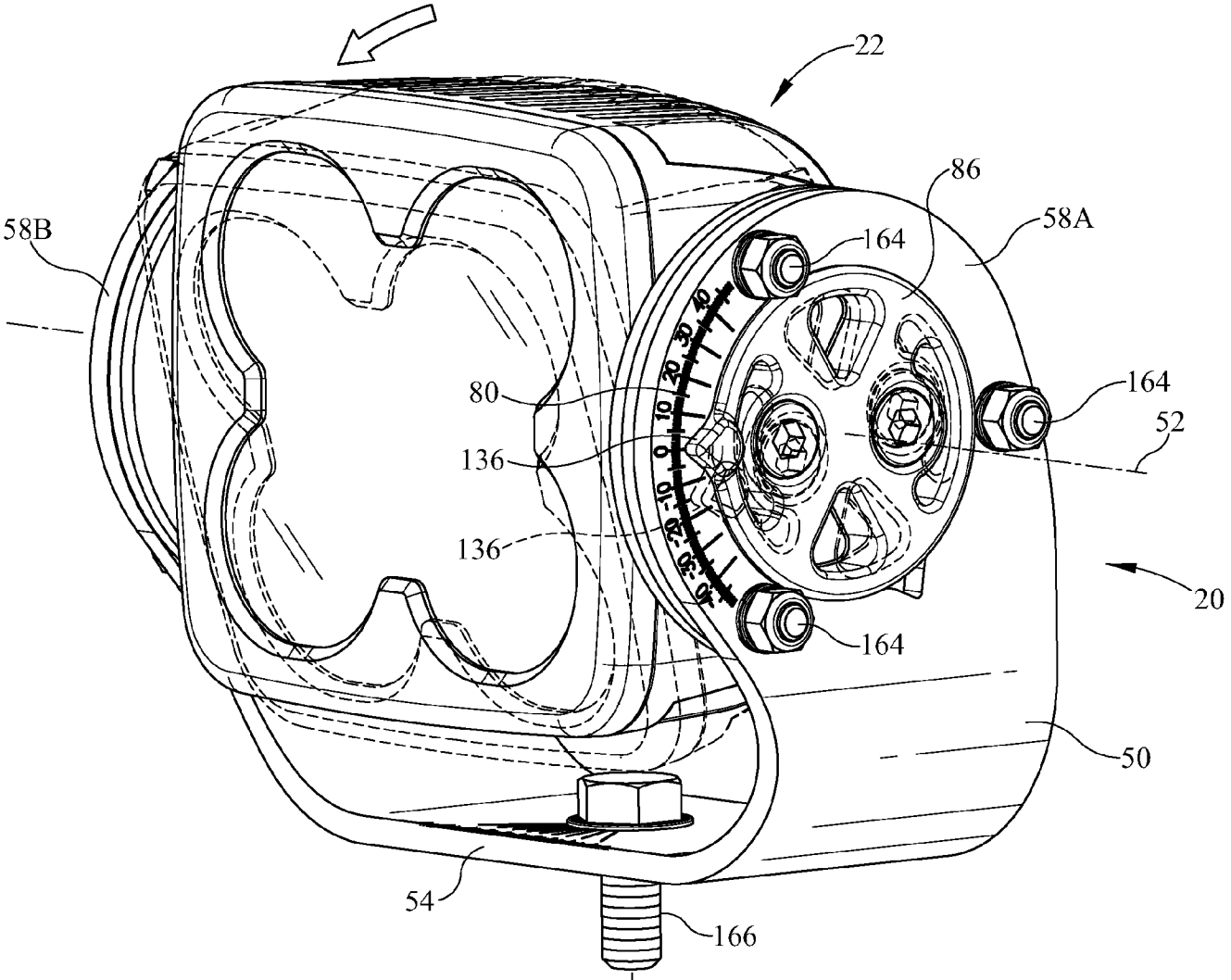
FIG. 6 is a perspective view of the mounting apparatus and lighting device illustrating the selective rotational movement of the lighting device with respect to the mounting bracket of the mounting apparatus.

Mounting apparatus 20 also includes a clamping member 150 adapted to selectively clamp flange 90 of trunnion 86 against interior surface 68 of ear 58A, as shown in FIGS. 2 & 3. Clamping member 150 comprises a generally annular plate-like ring having a central aperture 152 forming a generally circular interior rim 154 and a generally circular exterior rim 156. Clamping member 150 includes a generally planar first surface 158 and a generally planar second surface 160 spaced apart from and generally parallel to first surface 158. Clamping member 150 includes a plurality of peripheral apertures 162A-C that extend from first surface 158 to second surface 160. Apertures 162A-C are equally spaced apart from one another about the central axis of central aperture 152 which is coaxially aligned with rotational axis 52. Each peripheral aperture 162A-C is aligned with a respective slot 100A-C of flange 90 of trunnion 86 and with a respective peripheral aperture 72A-C of ear 58A.

A respective locking member 164 extends through each set of aligned apertures 162A-C, slots 100A-C and peripheral apertures 72A-C, such that clamping member 150 is coupled to ear 58A. Each locking member 164 may comprise a threaded bolt or stud and a threaded nut threadably attached thereto or other type locking member or fastener know to those skilled in the art. Alternatively, each locking member 164 may be attached to first surface 158 of clamping member 150 by welding or the like, such that locking member 164 does not pass through any aperture in clamping member 150. Locking members 164 inhibit rotational movement of clamping member 150 about central rotational axis 52. However, locking members 164 allow selective movement of clamping member 150 along rotational axis 52 toward or away from ear 58A between a locked position and an unlocked position to allow for adjustment of lighting device 22.

A trunnion 86, second indicator 136, fasteners 144A-B, clamping member 150 and locking members 164 may be associated with ear 58B of mounting bracket 50 as described above in connection with ear 58A.

When locking members 164 are loosened and clamping members 150 are in the unlocked position, trunnions 86 and lighting device 22 may be selectively rotated about rotational axis 52 with respect to ears 58A and B and mounting bracket 50 from a first rotational position, wherein locking members 164 are located at first ends 102 of slots 100A-C of flange 90, to a second rotational position wherein locking members 164 are located adjacent second end 104 of slots 100A-C of flange 90, and to any position therebetween. As lighting device 22 and trunnions 86 are selectively rotated about rotational axis 52 with respect to mounting bracket 50, each second indicator 136 conjointly rotates therewith with respect to its associated first indicator 80, to inform the user as to the position of the lighting device 22. Second indicator 136 may be selectively positioned and located with a desired indicia 82 of first indicator 80 to thereby selectively rotationally position lighting device 22 and trunnion 86 in a desired position with respect to mounting bracket 50. The amount or degree of rotation of lighting device 22 and trunnion 86 with respect to mounting bracket 50 is measured by the position of second indicator 136 with respect to first indicator 80.

When lighting device 22 and trunnion 86 are located in the desired selected rotational position with respect to mounting bracket 50 as measured by second indicator 136 and first indicator 80, locking members 164 may be tightened to clamp flanges 90 between clamping members 150 and ears 58A and B to thereby inhibit and prevent rotational movement of trunnion 86 and lighting device 22 with respect to mounting bracket 50.

Base 54 of mounting bracket 50 may be selectively connected to a fixture (not shown) by a fastener 166 that extends through aperture 56 such that mounting apparatus 20 and lighting device 22 can be selectively rotated about an axis 168 extending through aperture 56 of mounting bracket 50 with respect to the fixture. Axis 168 is generally perpendicular to rotational axis 52. A top surface of base 54 of mounting bracket 50 may include a plurality of visual indicator indicia 169 such as lines that extend radially outwardly with respect to axis 168. Indicator indicia 169 can be used to selectively rotate lighting device 22 and mounting apparatus 20 about axis 168 to a desired position with respect to the fixture.

Mounting apparatus 20 and lighting device 22 can be mounted to various types of fixtures, such as on-road and off-road vehicles, including automobiles, trucks, dune buggies, all-terrain vehicles, boats, planes and the like. The fixture may also comprise a stationary object such as a pole or wall. The fixture may also comprise a component such as a lighting bar that is attached to a vehicle.

When mounting apparatus 20 and lighting device 22 are attached to a vehicle, the lighting device 22 may be rotated about rotational axis 52 to a desired position as indicated by the second indicator 136 with respect to the first indicator 80, such that light emitted from the lighting device 22 illuminates an area of ground or road a desired distance from the vehicle. Mounting apparatus 20 enables light emitted from lighting device 22 to be precisely aimed due to the ability to precisely measure the amount or degree of rotational movement of lighting device 22 and trunnion 86 with respect to mounting bracket 50 by precise measured positioning of first indicator 80 and second indicator 136 with respect to one another. The viewable position of second indicator 136 with respect to first indicator 80 also enables a user to confirm that lighting device 22 is in the desired position with respect to mounting bracket 50, and that lighting device 22 has not rotated from its desired position due to vibration or the like.

While mounting apparatus 20 has been shown and described herein as including two ears 58A and B with respective trunnions 86 and clamping members 150 coupled to each ear 58A and B, only a single ear and a single trunnion 86 and clamping member 150 can be used to rotationally couple lighting device 22 to mounting bracket 50. Alternatively, one of the two ears may include a pivot member for rotationally coupling lighting device 22 to that ear.

Another embodiment of the mounting apparatus of the present disclosure is shown in FIGS. 14-19 as mounting apparatus 170. Mounting apparatus 170 is adapted to adjustably position the same lighting device 22 as is the mounting apparatus 20. Mounting apparatus 170 includes a mounting bracket 172 to which lighting device 22 is adapted to be rotationally coupled for selective movement about a rotational axis 174 with respect to mounting bracket 172. Mounting bracket 172 includes a generally planar base 176 having a central aperture 178. Mounting bracket 172 also includes ears 180A and B that are connected to opposite ends of base 176 and that are spaced apart and generally parallel to one another. If desired, mounting bracket 172 may only include a single ear.

Figure 14:
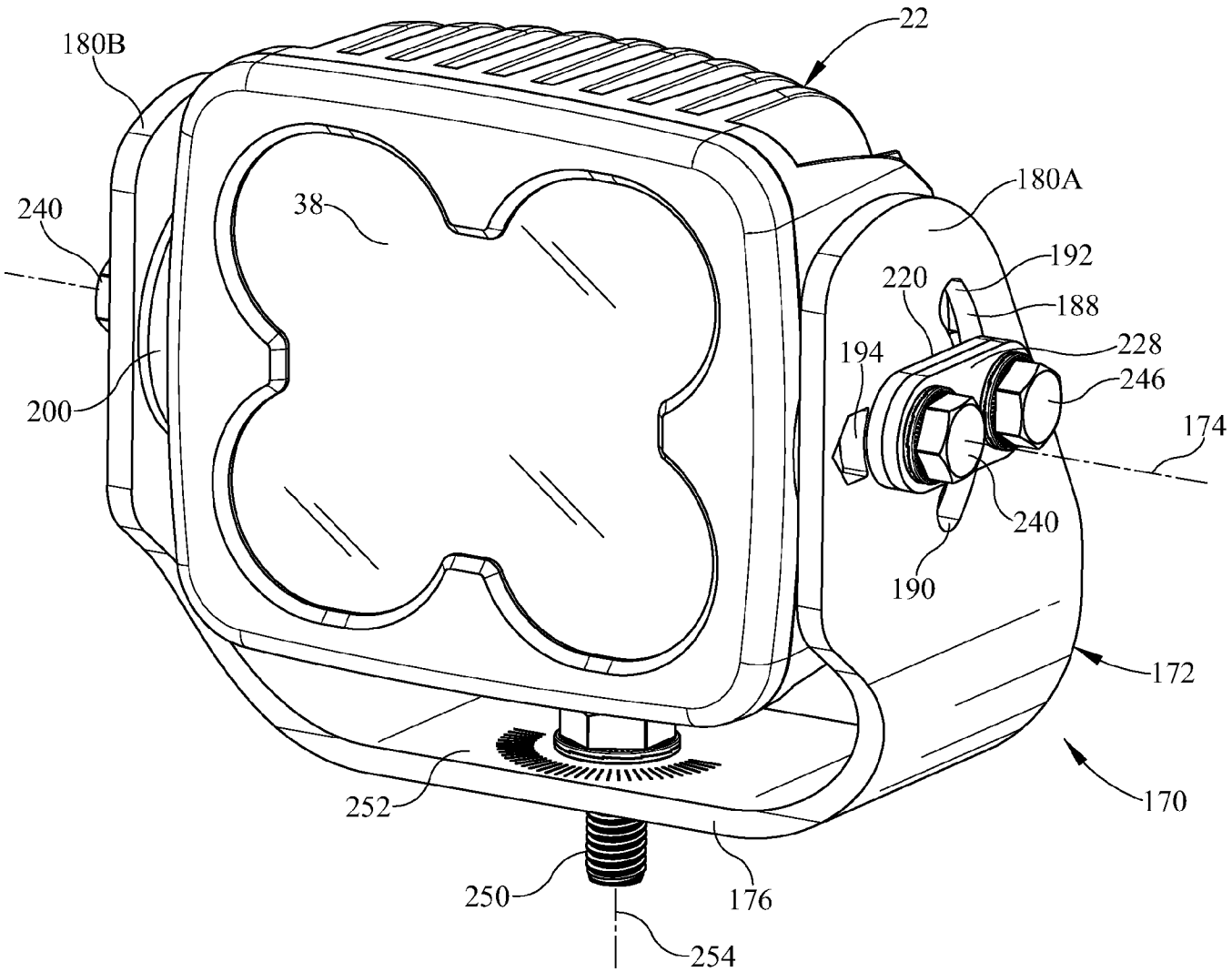
FIG. 14 is a perspective view of another embodiment of the mounting apparatus of the present disclosure shown with a lighting device rotationally coupled to the mounting bracket of the mounting apparatus.

Each ear 180A-B includes a generally planar interior surface 182 that is spaced apart from and generally parallel to a planar exterior surface 184, as shown in FIG. 14. Each ear 180A-B also includes a generally circular aperture 186 that extends from interior surface 182 to exterior surface 184 generally concentrically about rotational axis 174. Each ear 180A-B also includes an elongate curved arcuate slot 188 that extends from a first end 190 to a second end 192. Slot 188 extends from interior surface 182 to exterior surface 184 and is curved in an arc at a radial distance from the central axis of aperture 186 and rotational axis 174. Each ear 180A-B also includes a first indicator 194. First indicator 194 may comprise an aperture or window extending through each ear 180A and B from interior surface 182 to exterior surface 184. The window of first indicator 194 may include adjacent V-shaped walls that form a pointer having a tip 196.

Figure 15:
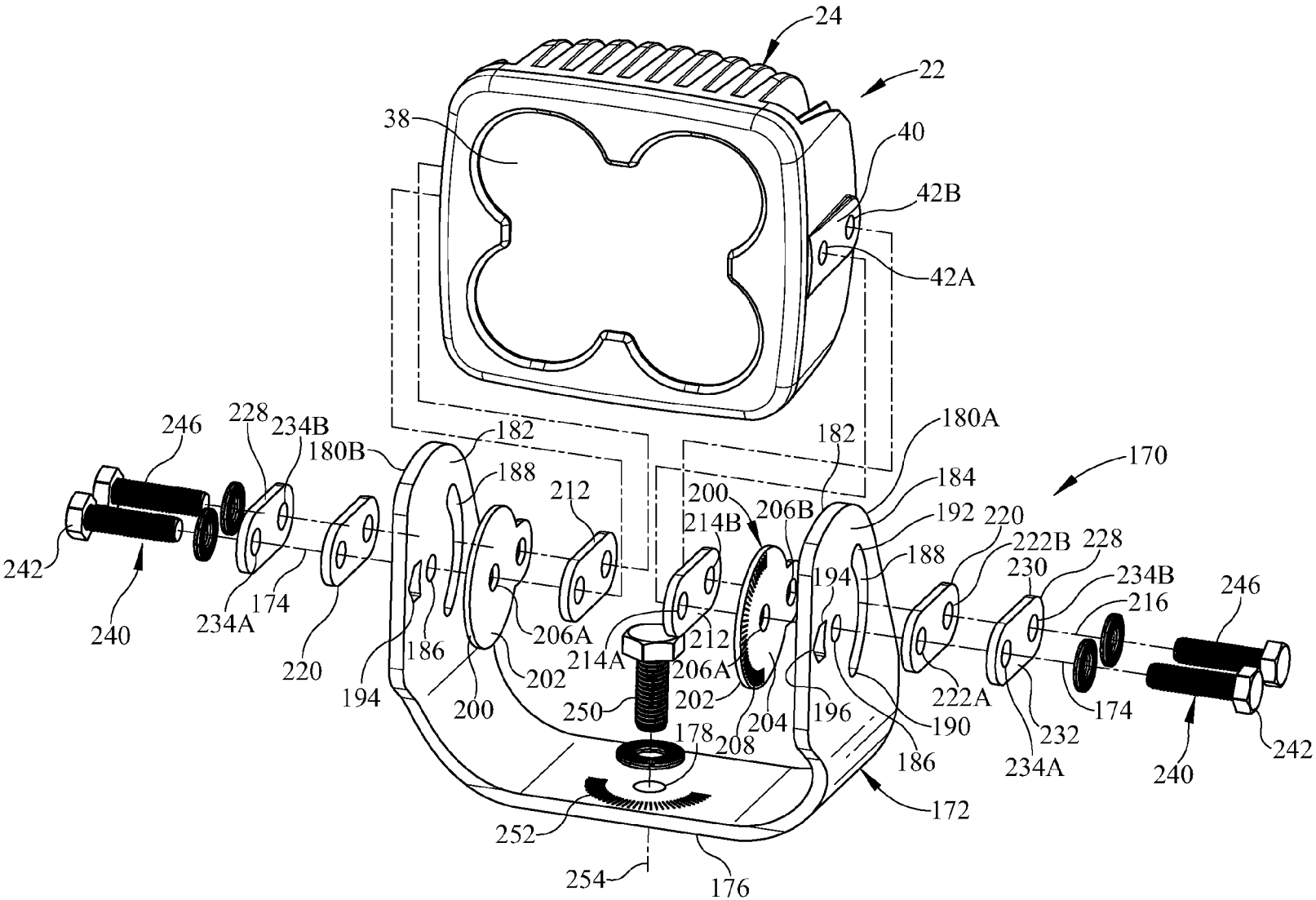
FIG. 15 is an exploded perspective view of the mounting assembly and lighting device of FIG. 14.
Figure 16:
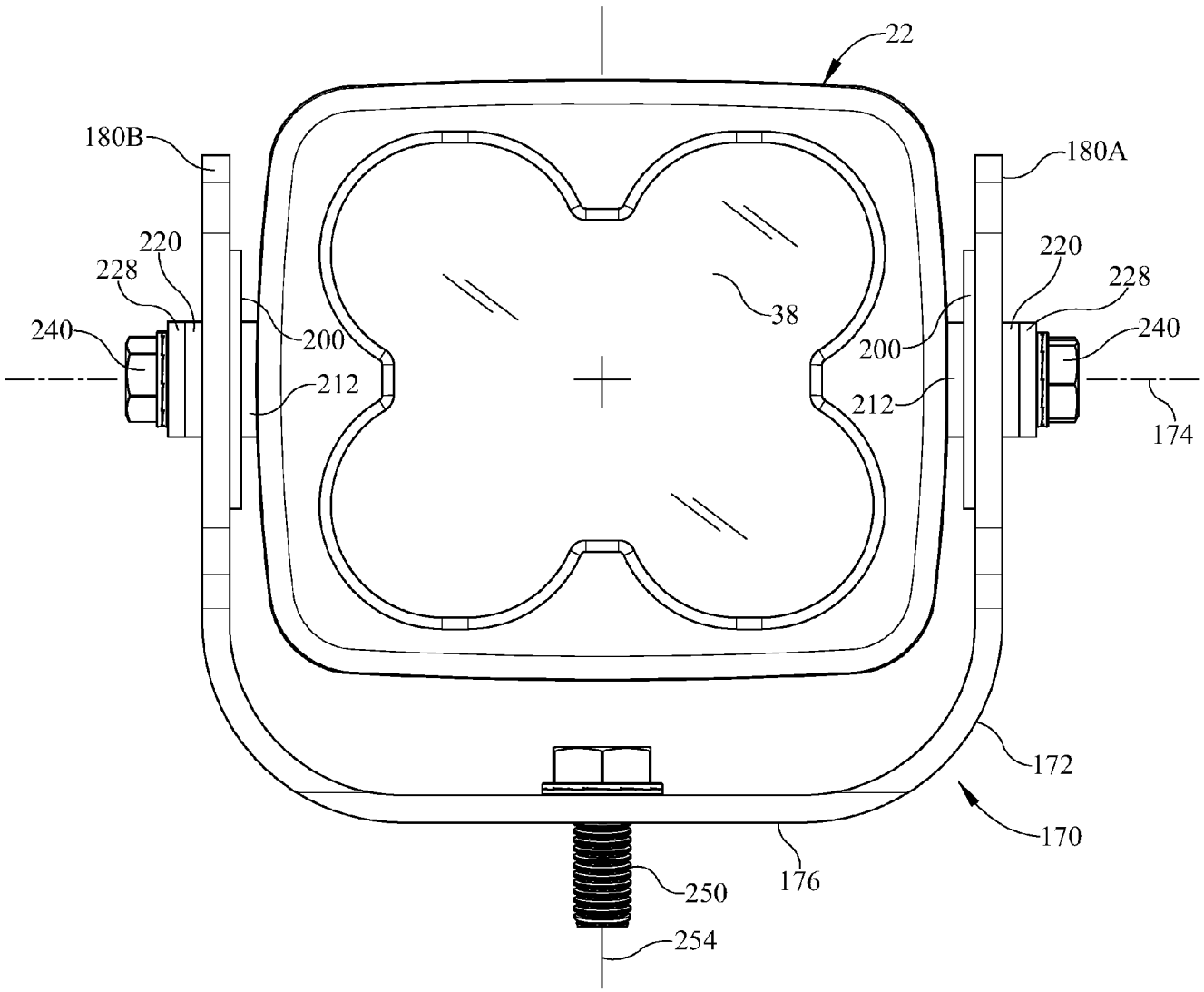
FIG. 16 is a front elevational view of the mounting assembly and lighting device of FIG. 14.
Figure 17:
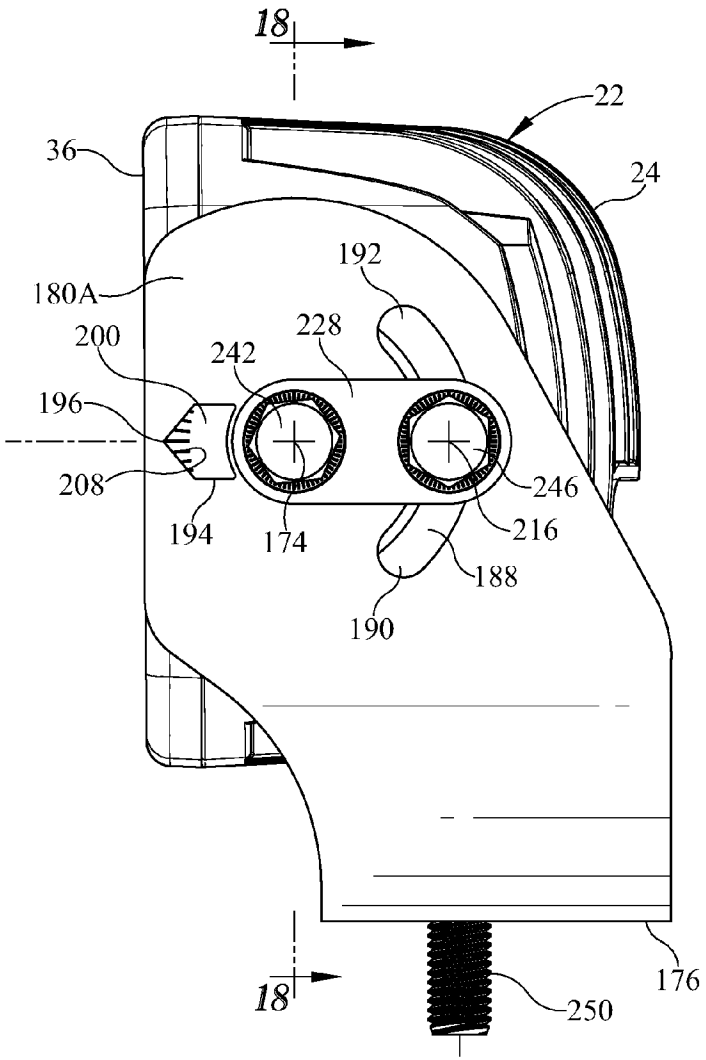
FIG. 17 is a side elevational view of the mounting apparatus and lighting device of FIG. 14.
Figure 18:
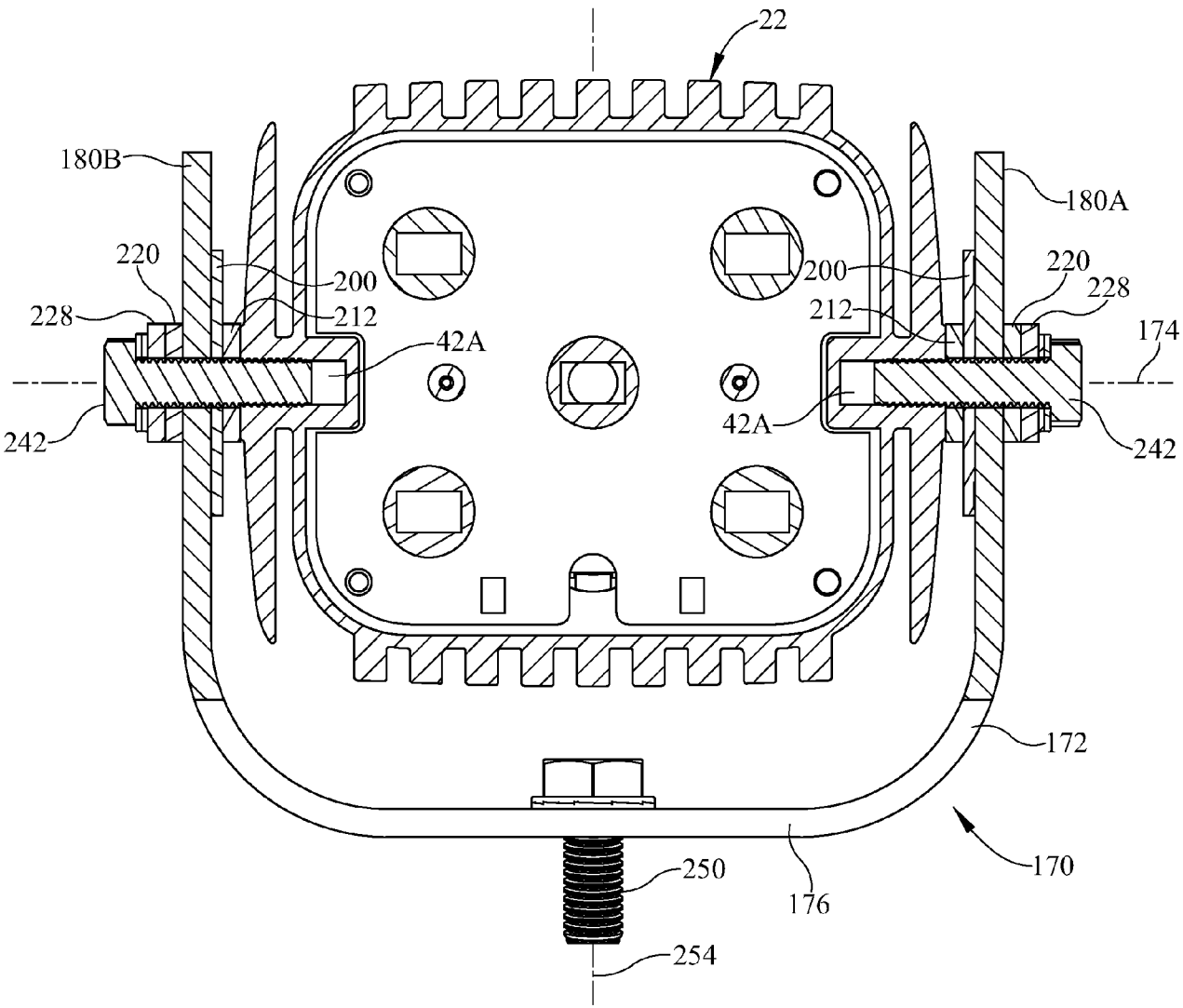
FIG. 18 is a cross sectional view of the mounting assembly and lighting device taken along line 18-18 of FIG. 17.
Figure 19:
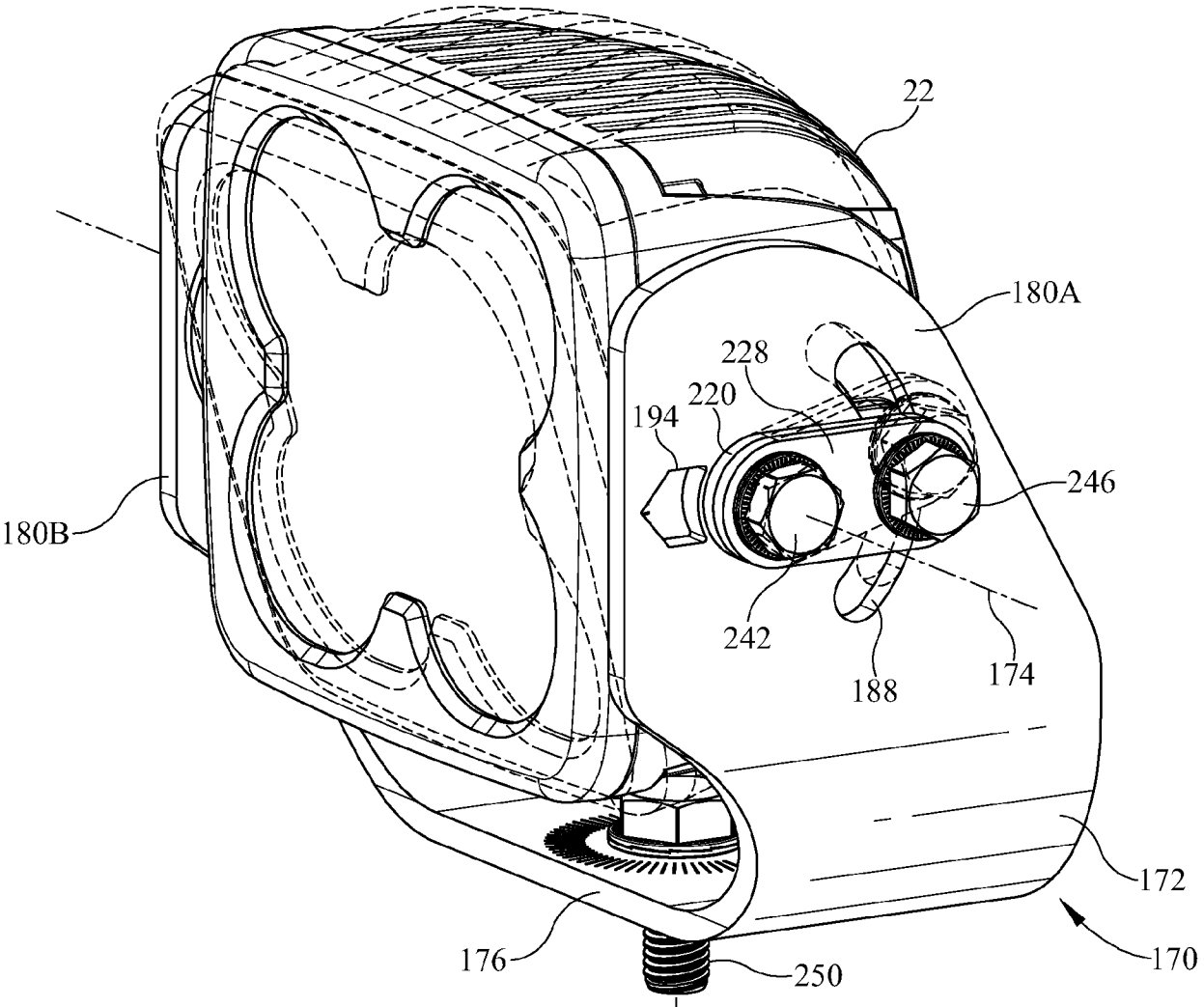
FIG. 19 is a perspective view of the mounting assembly and lighting device of FIG. 14 illustrating the selective rotational movement of the lighting device with respect to the mounting bracket of the mounting apparatus.

Mounting apparatus 170 includes a second indicator 200 adapted to be fixedly attached to lighting device 22 and rotationally coupled to ear 180A, as shown in FIG. 15. Second indicator 200 comprises a plate-like member having a generally planar interior surface 202 and a spaced apart and generally parallel planar exterior surface 204. Exterior surface 204 is adapted to be located adjacent interior surface 182 of ear 180A. Second indicator 200 includes generally circular apertures 206A-B that extend from interior surface 202 to exterior surface 204 and that are spaced apart from one another the same distance that aperture 186 and slot 188 of ear 180A are spaced apart from one another. Aperture 206A is coaxially aligned with aperture 186 and rotational axis 174, and aperture 206B is aligned with slot 188 of ear 180A. Second indicator 200 includes a plurality of visual indicia 208 that may be located on exterior surface 204 and spaced apart from aperture 206A. Indicia 208 may comprise a graduated scale including a plurality of markings indicating, for example, degrees of rotation about the central axis of aperture 206A and rotational axis 174. Indicia 208 are viewable through the aperture or window of first indicator 194.

Mounting apparatus 170 includes an interior pad 212 that can be formed of an elastomeric material and that includes spaced apart apertures 214A-B, as shown in FIG. 15. Pad 212 is adapted to be located between interior surface 202 of second indicator 200 and mounting base 40 of lighting device 22 with aperture 214A coaxially aligned with aperture 206A of second indicator 200 and aperture 42A of lighting device 22 along rotational axis 174. Aperture 214B of pad 212 is coaxially aligned along an axis 216 that extends concentrically through aperture 206B of second indicator 200 and aperture 42B of lighting device 22. Axis 216 is parallel to rotational axis 174.

Mounting apparatus 170 includes an exterior pad 220 that can be formed of an elastomeric material that is adapted to be located adjacent exterior surface 184 of ear 180A. Pad 220 includes spaced apart and generally circular apertures 222A-B. Aperture 222A is coaxially aligned with aperture 186 of ear 180A and with rotational axis 174. Aperture 222B is coaxially aligned with axis 216, with slot 188 of ear 180A, with aperture 206B of second indicator 200 and aperture 214B of interior pad 212.

Mounting apparatus 170 also includes a clamping member 228 that is generally plate-like, as shown in FIG. 15. Clamping member 228 includes a generally planar interior surface 230 and is spaced apart from and generally parallel to a planar exterior surface 232. Clamping member 228 includes spaced apart apertures 234A and B that extend from interior surface 230 to exterior surface 232. Aperture 234A is coaxially aligned with rotational axis 174, aperture 222A of exterior pad 220, aperture 186 of ear 180A, aperture 206A of second indicator 200, aperture 214A of interior pad 212 and aperture 42A of lighting device 22. Aperture 234B is coaxially aligned with axis 216, aperture 222B of exterior pad 220, slot 188 of ear 180A, aperture 206B of second indicator 200, aperture 214B of interior pad 212 and aperture 42B of lighting device 22. Clamping member 228 may be formed from metal, such as stainless steel.

Mounting apparatus 170 includes a pivot member 240 that may comprise a generally cylindrical shaft, as shown in FIG. 15. Pivot member 240 extends longitudinally and coaxially along rotational axis 174 through apertures 234A, 222A, 186, 206A and 214A and is adapted to be inserted into aperture 42A of lighting device 22 for selective attachment thereto. Pivot member 240 may comprise a locking member 242 such as a fastener, including threaded fasteners such as bolts or screws.

Mounting apparatus 170 also includes a locking member 246 that may comprise a fastener, such as a threaded fastener, including bolts and screws, as shown in FIG. 15. Locking member 246 extends along axis 216 through aperture 234B of clamping member 228, aperture 222B of exterior pad 220, slot 188 of ear 180A, aperture 206B of second indicator 200, aperture 214B of interior pad 212 and into aperture 42B of lighting device 22, such that locking member 246 is attached to lighting device 22.

Clamping member 228 may be selectively moved from an unlocked position toward a locked position by tightening locking members 242 and 246, whereupon exterior pad 220 becomes clamped between clamping member 228 and ear 180A, and second indicator 200 and interior pad 212 become clamped between mounting base 40 of lighting device 22 and ear 180A. When clamping member 228 is in the locked position, lighting device 22, interior pad 212, second indicator 200, exterior pad 220 and clamping member 228 are prevented or inhibited from rotating about rotational axis 174 with respect to ear 180A and mounting bracket 172. Alternatively, if desired, locking member 242 may be retained in a loosened condition and only locking member 246 may be tightened to move clamping member 228 from the unlocked position toward the locked position to prevent or inhibit rotational movement of lighting device 22 about rotational axis 174 with respect to mounting bracket 172.

Locking members 242 and 246 may be loosened such that clamping member 228 moves from the locked position toward an unlocked position to thereby release the clamping forces applied by clamping member 228, such that lighting device 22, interior pad 212, second indicator 200, exterior pad 220 and clamping member 228 are selectively rotatable about rotational axis 174 with respect to ear 180A and mounting bracket 172, with locking member 246 slidably moveable within slot 188 of ear 180A between first end 190 and second end 192.

Lighting device 22 and second indicator 200 conjointly rotate with one another about rotational axis 174 with respect to mounting bracket 172 such that a selected indicia of second indicator 200 can be aligned with tip 196 of first indicator 174, such that lighting device 22 is located in a desired position with respect to mounting bracket 172 as measured by the location of second indicator 200 with respect to first indicator 194.

A fastener 250 is adapted to selectively attach mounting bracket 172 to a fixture through aperture 178, as shown in FIG. 15. Base 176 may include a plurality of visual indicia 252 for indicating a desired amount of rotation of mounting bracket 172 about an axis 254 that extends through aperture 178 and that is generally perpendicular to rotational axis 174.

Ear 180B of mounting bracket 172 may be constructed in the same manner as ear 180A, and may be associated with a second indicator 200, interior pad 212, exterior pad 220, clamping member 228, pivot member 240 and locking member 246 as is ear 180A, as described above. Such components operate in the same manner as described above in connection with ear 180A. Locking members 242 and 246 associated with each ear 180A and B should be simultaneously loosened or tightened to selectively allow rotational movement of lighting device 22 or to prevent or inhibit rotational movement of lighting device 22 with respect to mounting bracket 172. Alternatively, ear 180B can be provided with just a pivot member for rotationally coupling lighting device 22 to ear 180B.

FIGS. 20-23 show a vibration isolating mounting device 260 that is adapted to couple a lighting device 262 to a mounting apparatus such as mounting apparatus 20 or 170. As shown in the drawing figures, two mounting devices 260 are adapted to be coupled to a lighting device 262. Lighting device 262 with two mounting devices 260 coupled thereto is adapted to be interchangeably coupled to mounting apparatus 20 or mounting apparatus 170 in place of lighting device 22. Lighting device 262 and mounting devices 260 are adapted to be selectively rotatable about rotational axis 52 or 174 with respect to the mounting bracket of mounting apparatus 20 or 170.

Lighting device 262 includes a housing 264 having an interior chamber. Housing 264 includes a generally planar side wall 266 and a generally planar side wall 268 that is spaced apart from and generally parallel to side wall 266. Housing 264 also includes a bottom wall 270 that extends between bottom edges of side walls 266 and 268 and a top wall 272 that is spaced apart from and generally parallel to bottom wall 270 and that extends between top ends of side walls 266 and 268. Housing 264 also includes a rear wall 274 that extends from rear edges of bottom wall 270 and top wall 272 and side walls 266 and 268. Rear wall 274 may include a center wall portion and upper and lower inclined wall portions that respectively extend between the center wall portion and bottom wall 270 and the center wall portion and top wall 272. A plurality of grooves and slots may be formed in bottom wall 270, top wall 272 and rear wall 274 to form fins.

Figure 20:
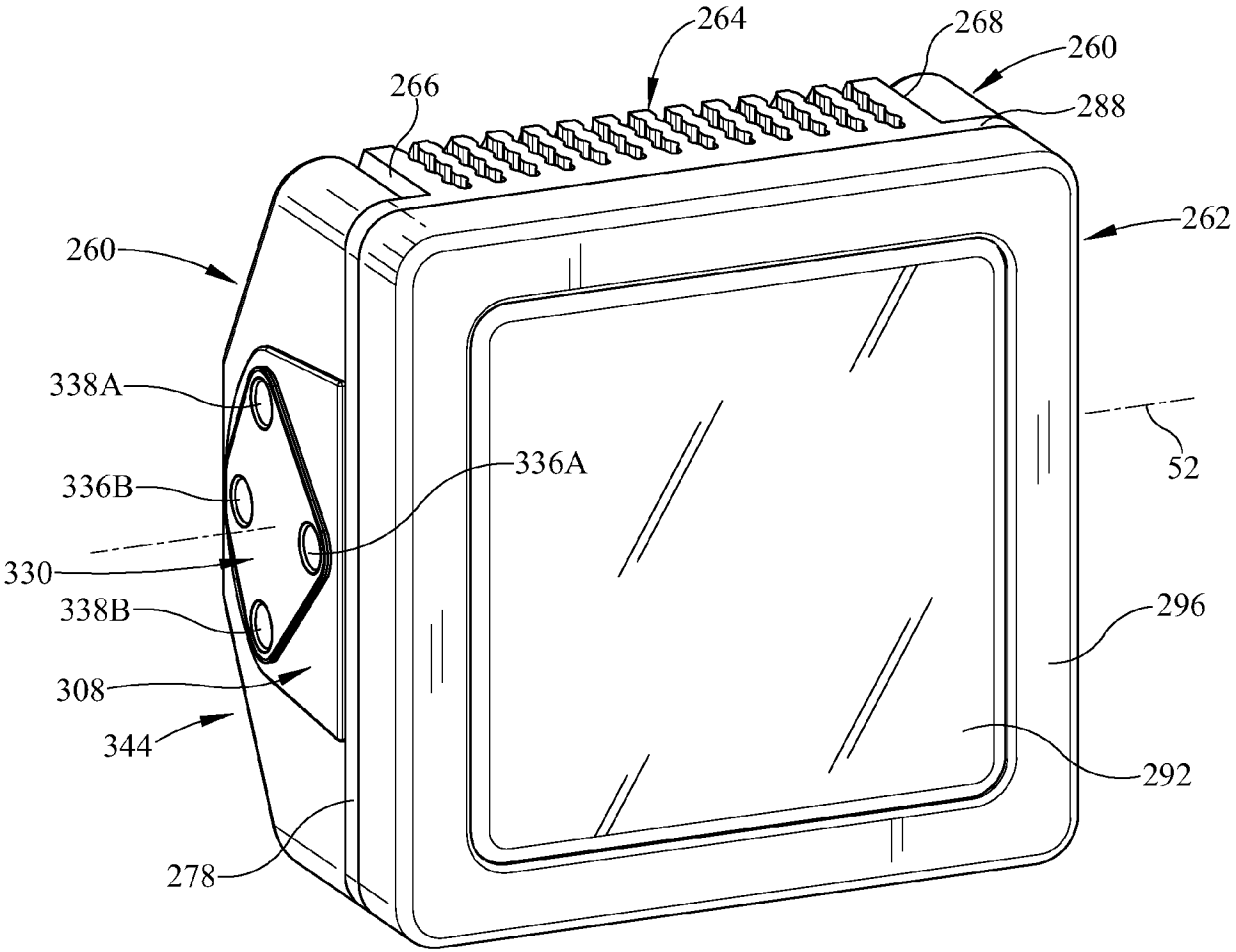
FIG. 20 is a perspective view of a lighting device including first and second vibration isolating mounting devices that can be selectively coupled to the mounting apparatus of FIG. 1 or the mounting apparatus of FIG. 14.
Figure 21:
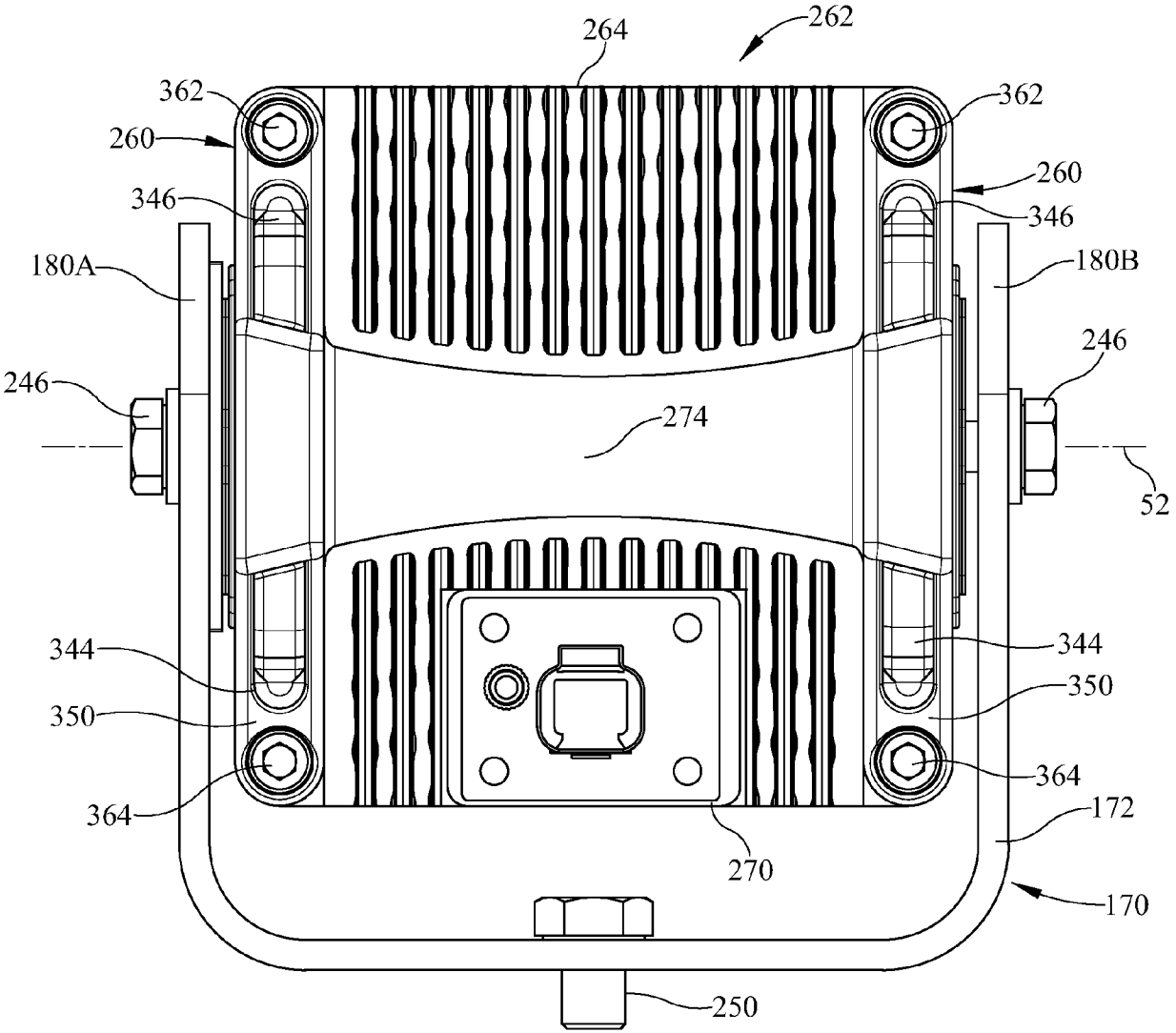
FIG. 21 is a rear elevational view of the lighting device and mounting devices of FIG. 20 shown coupled to the mounting apparatus of FIG. 14.
Figure 22:
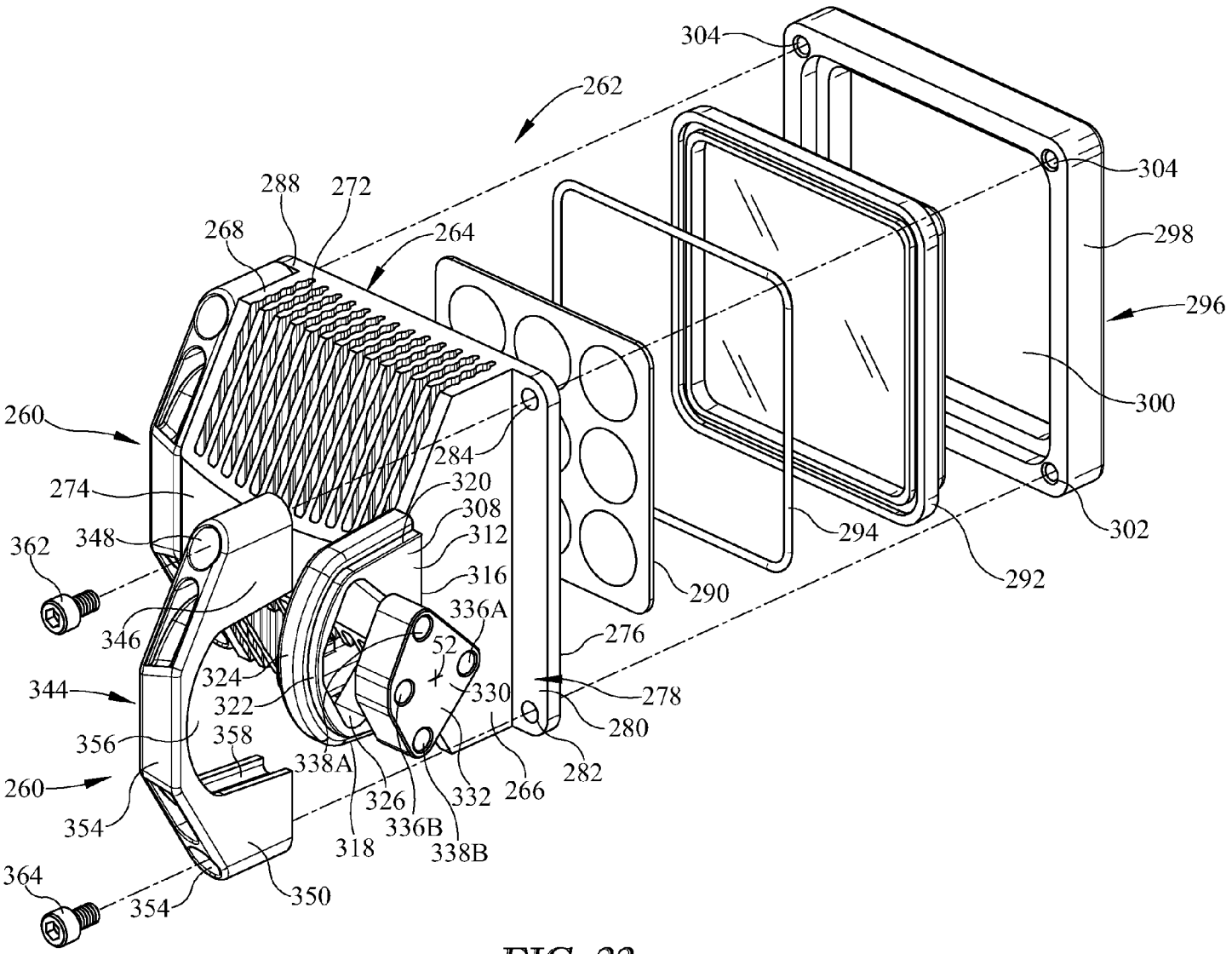
FIG. 22 is a partially exploded view of the lighting device and of one of the vibration isolating mounting devices.

Front wall 276 of housing 264 includes a generally plate-like flange 278 that extends outwardly from side wall 266 at a generally right angle thereto, as shown in FIG. 20. Flange 278 extends between a top end located adjacent top wall 272 and a bottom end located adjacent bottom wall 270. Flange 278 includes a generally planar rear surface 280 that is spaced apart from and parallel to a planar front surface of front wall 276, as shown in FIG. 22. A bottom aperture 282 extends through a bottom end of flange 278 and a top aperture 284 extends through a top end of flange 278 between the rear surface 280 and front surface of front wall 276. Front wall 276 also includes a flange 288 that extends outwardly at generally a right angle to side wall 268. Flange 288 is generally coplanar with flange 278 and extends generally parallel to flange 278 between a bottom end located adjacent bottom wall 270 and a top end located adjacent top wall 272. Flange 288 includes a rear surface and upper and lower apertures as does flange 278. Flange 278 and side wall 266 form a pocket and flange 288 and side wall 268 form a pocket adapted to receive respective mounting devices 260.

Lighting device 262 includes one or more light emitting devices 290, such as light bulbs or LEDs, within the chamber formed by housing 264. A lens 292, through which light from the light emitting devices 290 is adapted to project, is located in sealing engagement with front wall 276 of housing 264 by an elastomeric seal member 294, such as an O-ring. Lighting device 262 also includes a bezel 296 having a generally rectangular peripheral frame 298. Frame 298 forms a central opening 300 that is in communication with lens 292. Frame 298 includes a pair of bottom apertures 302 that are respectively coaxially aligned with apertures 282 of flanges 278 and 288, and a pair of upper apertures 304 that are coaxially aligned with respective upper apertures 284 of flanges 278 and 288. Bezel 296 is adapted to clamp lens 292 against seal member 294 and front wall 276 of housing 264 such that seal member 294 creates a water-tight seal between lens 292 and housing 264.

Figure 23:
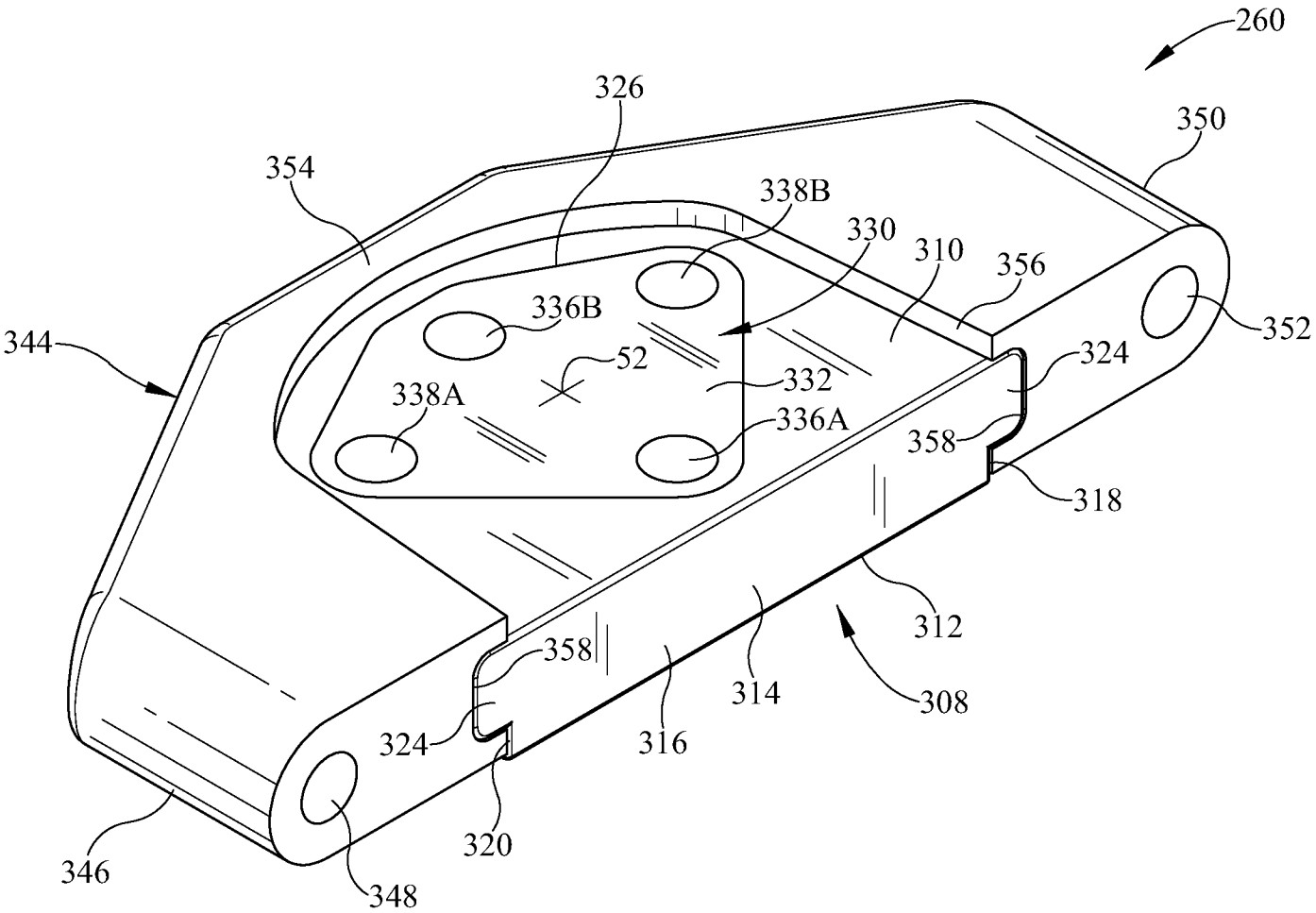
FIG. 23 is a perspective view of the vibration isolating mounting device.

Each mounting device 260 includes a vibration isolator member 308, as shown in FIG. 23. Isolator member 308 may be formed from a vibration reducing or absorbing material, such as an elastomeric material. The elastomeric material may be, for example, urethane or rubber. Isolator member 308 includes a generally planar interior wall 310 and a generally planar exterior wall 312 spaced apart from and generally parallel to interior wall 310. Isolator member 308 includes a peripheral edge 314 that extends around the perimeter of isolator member 308. Edge 314 includes a generally planar front wall 316. Edge 314 also includes a generally planar bottom wall 318 and a generally planar top wall 320 that is spaced apart from and generally parallel to bottom wall 318. Bottom wall 318 extends from a bottom end of front wall 316 at a generally right angle thereto and top wall 320 extends from a top end of front wall 316 at generally a right angle thereto. Edge 314 includes a generally curved arcuate end wall 322 that extends from a distal end of bottom wall 318 to a distal end of top wall 320. Edge 314 of isolator member 308 also includes a rib 324 that extends along and outwardly from front wall 316, arcuate end wall 322 and bottom wall 318 of isolator member 308. Isolator member 308 also includes an aperture 326 that extends from interior wall 310 to exterior wall 312 along rotational axis 52 or 174.

Mounting device 260 also includes a core member 330 located in aperture 326 of isolator member 308, as shown in FIG. 23. Core member 330 is coupled to isolator member 308 for conjoint rotation therewith about rotational axis 52 or 174. Isolator member 308 can be molded with core member 330 and clamp 344. Core member 330 includes a peripheral edge adapted to mattingly engage the peripheral edge of aperture 326. Core member 330 includes a generally planar interior surface 332 that is generally coplanar with interior wall 310 of isolator member 308, and a generally planar exterior surface 334 that is generally parallel to and spaced apart from interior surface 332. Exterior surface 334 is generally coplanar with exterior wall 312 of isolator member 308. Core member 330 includes apertures 336A and 336B that extend parallel to and spaced apart from one another from interior surface 332 to exterior surface 334 and that extend generally parallel to rotational axis 52 or 174.

Apertures 336A and B are adapted to receive fasteners 144A and B of mounting apparatus 20 and also locking members 242 and 246 of mounting apparatus 170. Core member 330 also includes apertures 338A and B that extend from interior surface 332 to exterior surface 334. Apertures 338A and B extend generally parallel to rotational axis 52 or 174 and are spaced apart from one another the same distance apertures 336A and B are spaced apart. Apertures 338A and B are located approximately ninety degrees with respect to apertures 336A and B. Apertures 338A and B are also adapted to respectively receive fasteners 144A and B of mounting apparatus 20 and locking members 242 and 246 of mounting apparatus 170. Core member 330 is thereby selectively coupled to mounting apparatus 20 or mounting apparatus 170 for selective rotation about rotational axis 52 or 174.

Mounting device 260 also includes a generally C-shaped clamp 344. Clamp 344 includes a post 346 having an aperture 348 and a post 350 having an aperture 352. Posts 346 and 350 are generally parallel to and spaced apart from one another. Apertures 348 and 352 are spaced apart and generally parallel to one another. Aperture 348 is adapted to be coaxially aligned with upper aperture 284 in flange 278 and upper aperture 304 of bezel 296. Aperture 352 of post 350 is adapted to be coaxially aligned with lower aperture 282 of flange 278 and lower aperture 302 of bezel 296. A strut 354 extends between distal ends of posts 346 and 350.

Clamp 344 includes an open-ended aperture 356 that is located between posts 346 and 350. Aperture 356 is open between proximal ends of posts 346 and 350. Clamp 344 includes a groove 358 that extends inwardly into posts 346 and 350 and strut 354. Groove 358 extends along aperture 352 from a proximal end of post 346 to a proximal end of post 350. Groove 358 of clamp 344 is adapted to receive rib 324 of isolator member 308. A locking member 362, such as a threaded fastener, is adapted to extend through aperture 348 of clamp 344, through upper aperture 284 of flange 278, and into upper aperture 304 of bezel 296.

A locking member 364, such as a threaded fastener, is adapted to extend through aperture 352 of post 350, through lower aperture 282 of flange 278, and into lower aperture 302 of bezel 296. Tightening of locking members 362 and 364 clamps front wall 316 of isolator member 308 into mating engagement with flange 278 of housing 264 between clamp 344 and flange 278 such that lighting device 262 and mounting device 260 are conjointly rotatable about rotational axis 52 or 174. Tightening of locking members 362 and 364 will also clamp lens 292 and seal member 294 between bezel 296 and front wall 276 of housing 264. Mounting device 260 may also be similarly coupled to flange 288 of housing 264.

Isolator members 308 of mounting devices 260 will prevent or inhibit the transfer of vibrations from mounting apparatus 20 or 170 and core member 330 to clamp 344 and lighting device 262 to thereby protect lighting device 262 from vibration.

Figure 24:
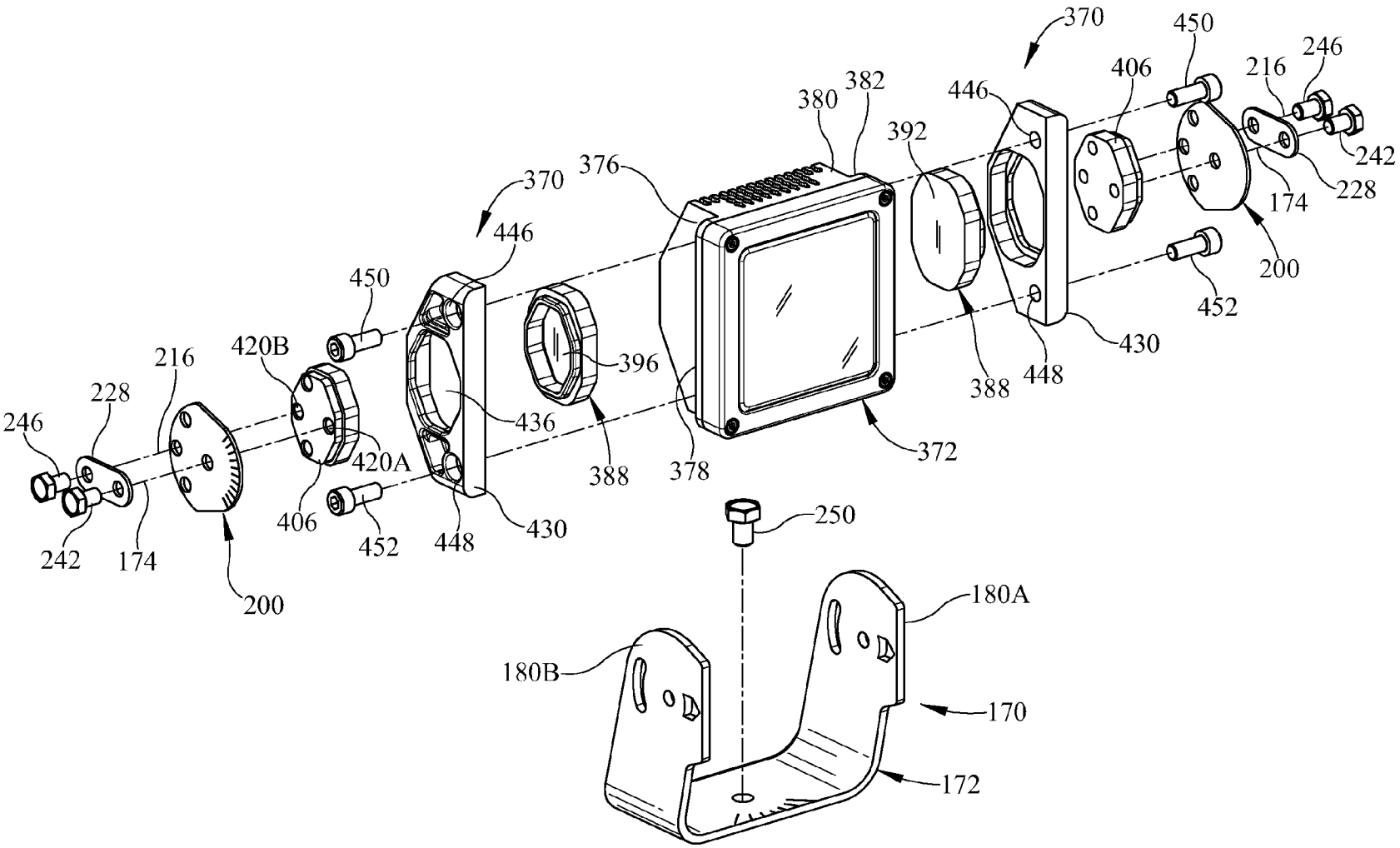
FIG. 24 is a partial exploded view of a lighting device including first and second vibration isolating mounting devices shown in connection with the mounting apparatus of FIG. 14.

FIGS. 24-29B show a vibration isolating mounting device 370 that is adapted to couple a lighting device 372 to a mounting apparatus, such as the mounting apparatus 170 as shown in FIG. 24. Lighting device 372 with mounting devices 370 may alternatively be coupled to mounting apparatus 20. As shown in FIG. 24, two mounting devices 370 are adapted to be coupled to lighting device 372. Lighting device 372 with two mounting devices 370 coupled thereto is adapted to be interchangeably coupled to mounting apparatus 20 or mounting apparatus 170 in place of lighting device 22.

Lighting device 372 is constructed similarly to lighting device 262. Lighting device 372 includes a housing 374 having an interior chamber, as shown in FIG. 24. Housing 374 includes a generally planar side wall 376 and a generally planar side wall 380 that is spaced apart from and generally parallel to side wall 376. Housing 374 includes a front wall having a generally plate-like flange 378 that extends outwardly from side wall 376 at generally a right angle thereto. The front wall of housing 374 also includes a generally plate-like flange 382 that extends outwardly from side wall 380 at a generally right angle thereto. Flanges 378 and 382 are generally coplanar with one another. Flange 378 and side wall 376 form a pocket and flange 382 and side wall 380 form a pocket adapted to receive respective mounting devices 370.

Figure 25:
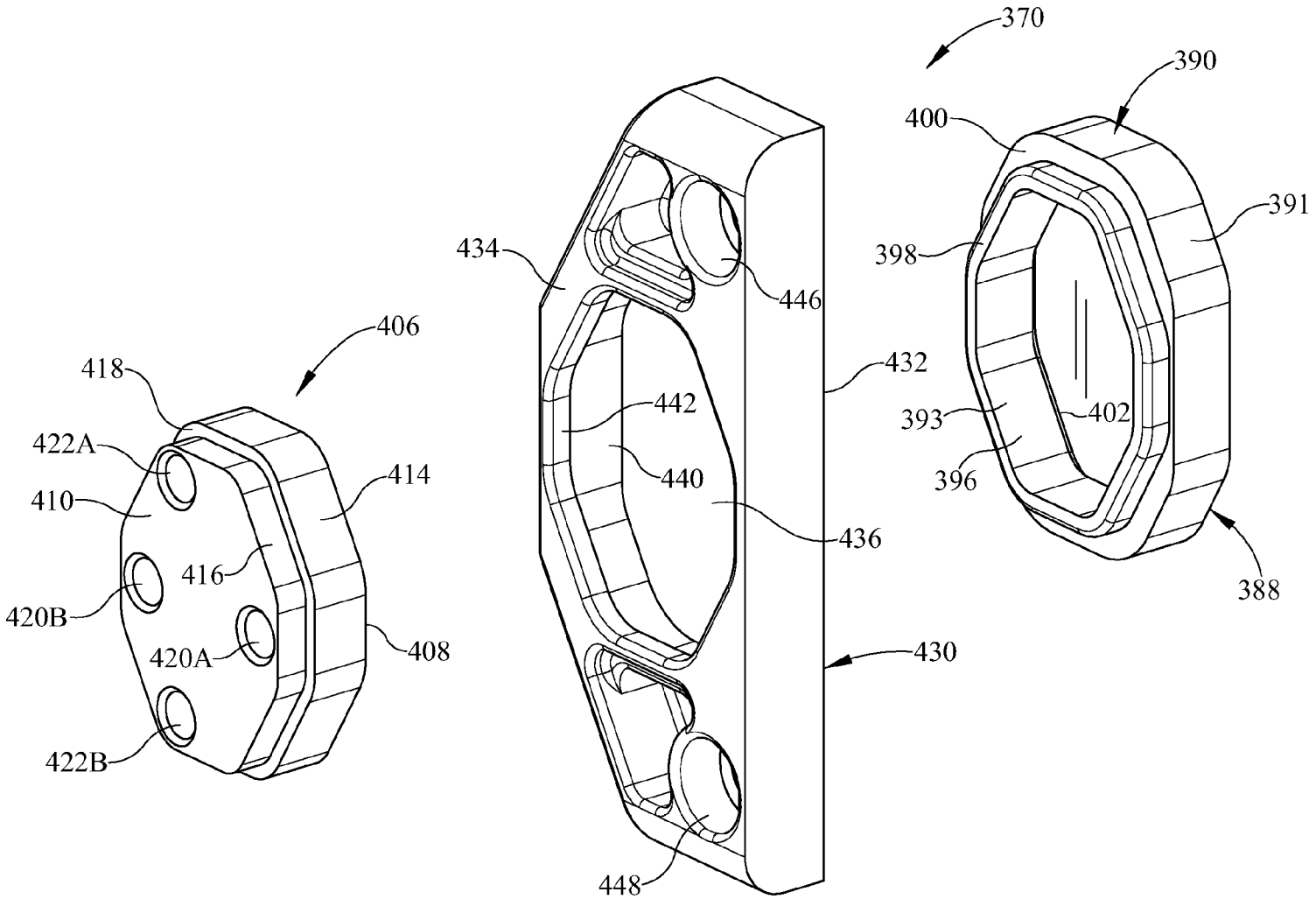
FIG. 25 is an exploded view of the vibration isolating mounting device of the lighting device of FIG. 24.
Figure 26C:
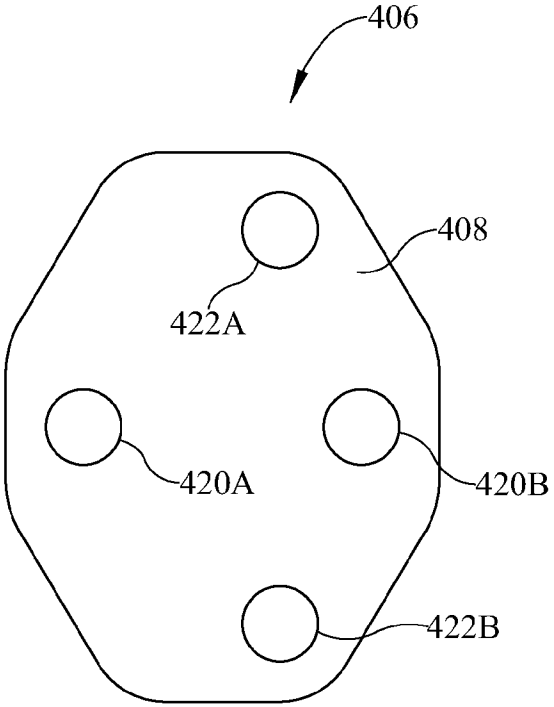
FIG. 26C is a rear view of the core of the vibration isolating mounting device.
Figure 26B:
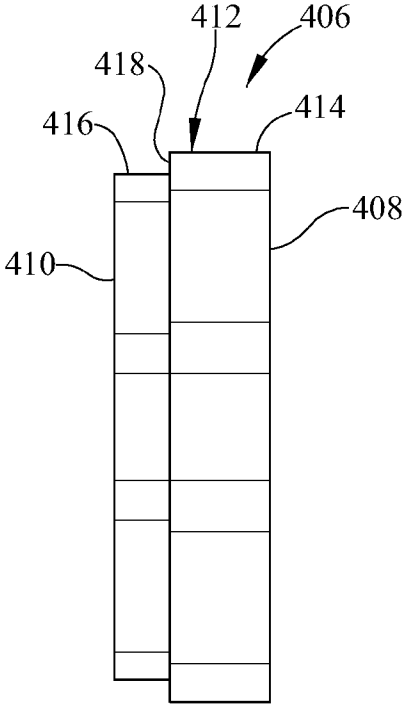
FIG. 26B is a side elevational view of the core of the vibration isolating mounting device.
Figure 26A:
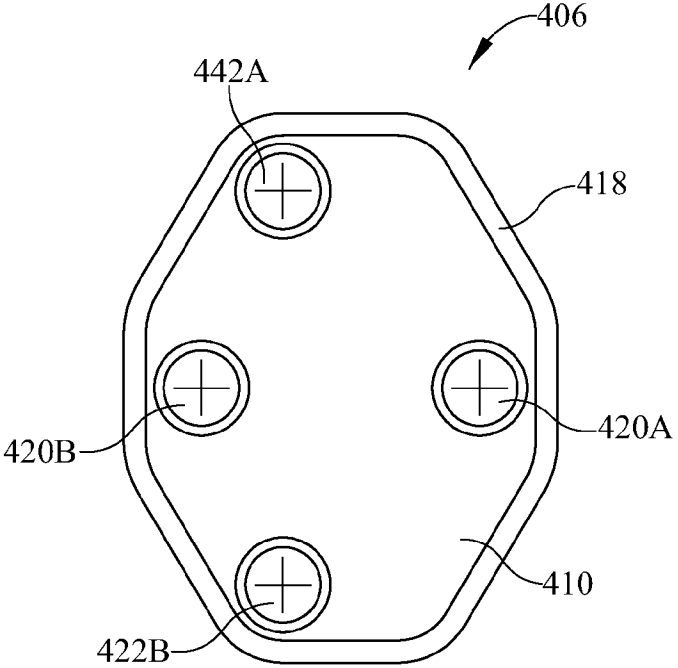
FIG. 26A is a front view of the core member of the vibration isolating mounting device.
Figure 27D:
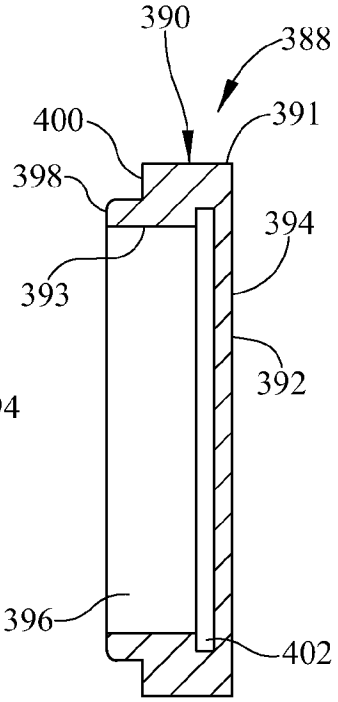
FIG. 27D is a cross-sectional view taken along line 27D-27D of FIG. 27A.
Figure 27C:
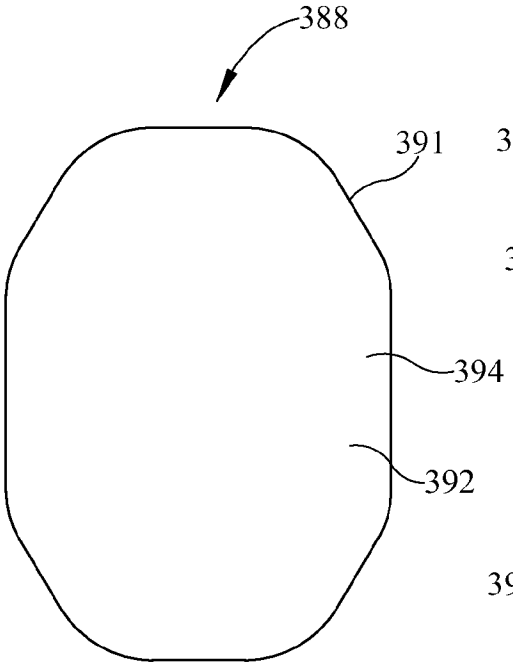
FIG. 27C is a rear view of the isolating member of the vibration isolating mounting device.
Figure 27B:
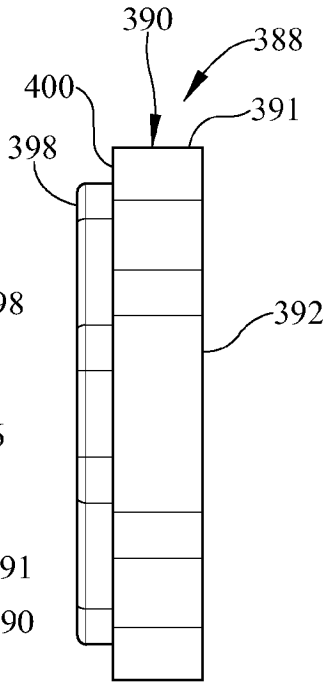
FIG. 27B is a side elevational view of the isolator member of the vibration isolating mounting device.
Figure 27A:
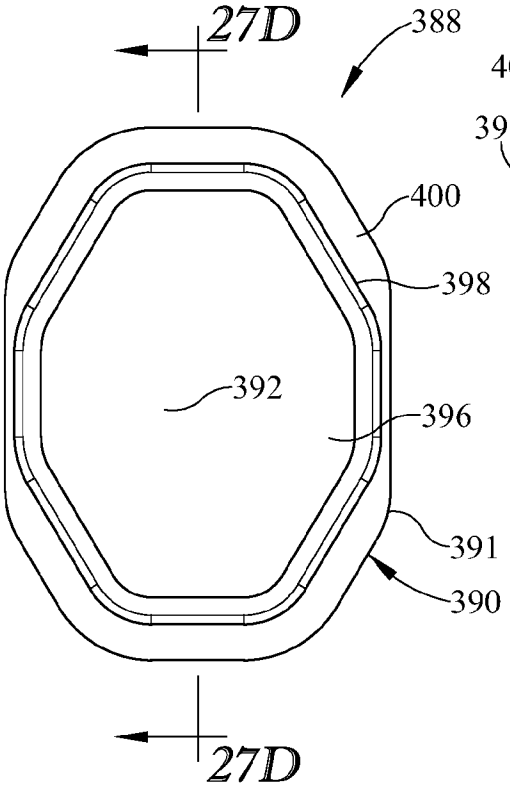
FIG. 27A is a front view of the isolator member of the vibration isolating mounting device.
Figure 28D:
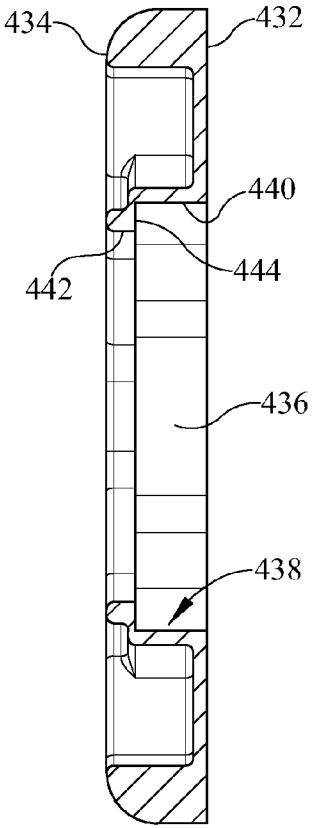
FIG. 28D is a cross sectional view taken along line 28D-28D of FIG. 28B.
Figure 28C:
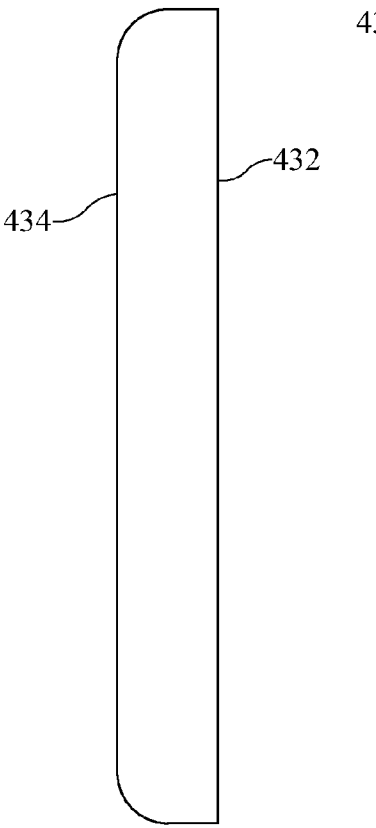
FIG. 28C is a rear elevational view of the clamp of the vibration isolating mounting device.
Figure 28B:
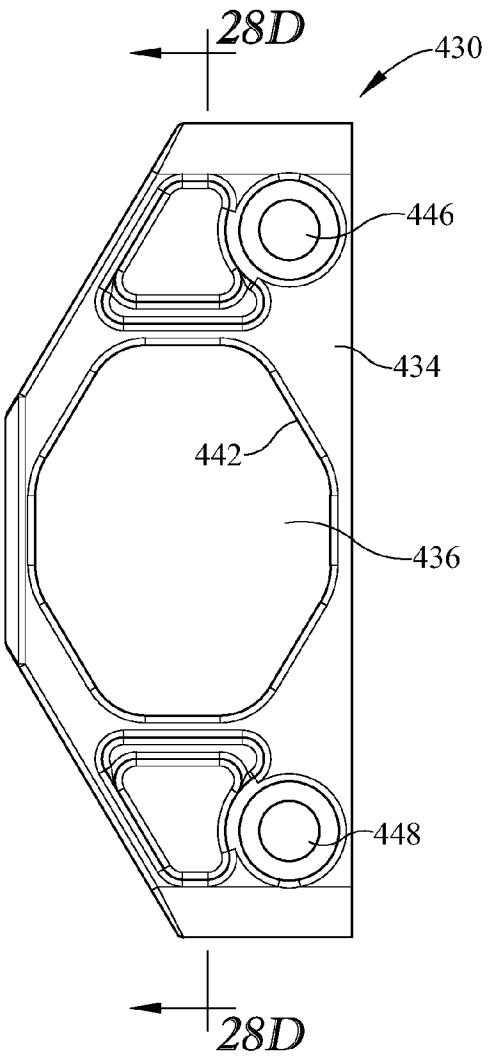
FIG. 28B is a side elevational view of the clamp of the vibration isolating mounting device.
Figure 28A:
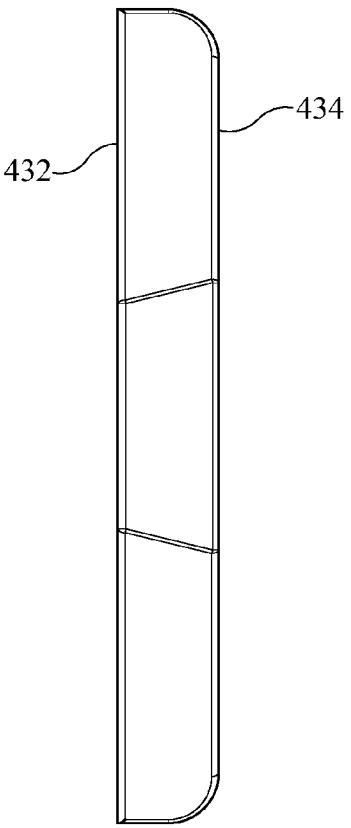
FIG. 28A is a front elevational view of the clamp of the vibration isolating mounting device.

Each mounting device 370 includes a vibration isolator member 388, as shown in FIGS. 24 and 25. Isolator member 388 may be formed from a vibration reducing or absorbing material, such as an elastomeric material. The elastomeric material may be, for example, urethane or rubber. Isolator member 388 includes a generally annular peripheral side wall 390 having an peripheral outer surface 391. Side wall 390 is closed at a proximal end by an end wall 392. End wall 392 includes a generally planar outer surface 394. A chamber 396 is formed within side wall 390 by an inner surface 393 of side wall 390. A generally annular peripheral lip 398 extends outwardly from and along side wall 390. Proximal end of side wall 390 forms a annular and peripheral ledge 400 that extends outwardly from lip 398. Side wall 390 and lip 398 may comprise a plurality of generally linear segments connected end to end, such as in a generally octagonal configuration. A peripheral groove 402 extends into a proximal end of inner surface 393 adjacent end wall 392.

Mounting device 370 also includes a core member 406, as shown in FIG. 25. Core member 406 includes a generally planar rear wall 408 and a generally planar front wall 410 spaced apart from and generally parallel to rear wall 408. A peripheral stepped side wall 412 extends between and along the perimeter of rear wall 408 and front wall 410. Side wall 412 includes an peripheral outer wall 414 that extends from rear wall 408 toward front wall 410 and an peripheral inner wall 416 that extends from front wall 410 toward rear wall 408. Inner wall 416 is generally concentrically aligned with respect to outer wall 414. Side wall 412 includes a peripheral ledge 418 that extends between the inner end of outer wall 414 and the inner end of inner wall 416 and that extends outwardly from and around inner wall 416.

Core member 406 includes apertures 420A and B that extend from rear wall 408 to front wall 410 and that extend generally parallel to rotational axis 52 or 174. Apertures 420A and B are spaced apart from one another the same distance that apertures 42A and B of lighting device 22 are spaced apart from one another. Apertures 420A and B are adapted to receive fasteners 144A and B of mounting apparatus 20 and also locking members 242 and 246 of mounting apparatus 170. Core member 406 also includes apertures 422A and B that extend generally parallel to one another from rear wall 408 to front wall 410. Apertures 422A and B extend generally parallel to rotational axis 52 or 174 and are spaced apart from one another the same distance apertures 420A and B are spaced apart.

Apertures 422A and B are rotated approximately ninety degrees with respect to apertures 420A and B. Apertures 422A and B are also adapted to respectively receive fasteners 144A and B of mounting apparatus 20 and locking members 242 and 246 of mounting apparatus 170. Core member 406 is thereby selectively coupled to mounting apparatus 20 or a mounting apparatus 170 for selective rotation about either rotational axis 52 or rotational axis 174. Core member 406 may be formed from metal or a hard plastic material. Outer wall 414 of side wall 412 of core member 406 is configured to correspond to the shape of inner surface 393 of side wall 390 and lip 398 of isolator member 388 such that outer wall 414 mattingly engages therewith when core member 406 is located in chamber 396 of isolator member 388.

Mounting device 370 also includes a bracket or clamp 430, as shown in FIG. 25. Clamp 430 includes a generally planar interior surface 432 that is adapted to be located adjacent a side wall of housing 374 of lighting device 372. Clamp 430 also includes an exterior surface 434 that is generally parallel to and spaced apart from interior surface 432. Aperture 436 extends through clamp 430 from interior surface 432 to exterior surface 434. Aperture 436 includes a peripheral stepped side wall 438 having an outer wall 440 that extends inwardly from interior surface 432 and an inner wall 442 that extends inwardly from exterior surface 434. An annular and peripheral ledge 444 extends between inner ends of outer wall 440 and inner wall 442. Aperture 436 is adapted to receive isolator member 388 such that outer surface 391 of isolator member 388 extends along in engagement with outer wall 440 of aperture 436 of clamp 430, and lip 398 of isolator member 388 extends along and in engagement with inner wall 442 of aperture 436 of clamp 430. Isolator member 388 thereby isolates core member 406 from direct engagement with clamp 430.

Clamp 430 includes an aperture 446 and a spaced apart and generally parallel aperture 448 that extend from interior surface 432 to exterior surface 434 and that are located on opposite sides of aperture 436, as shown in FIG. 25. A fastener 450, such as a threaded fastener, is adapted to extend through aperture 446 and to be threadably coupled to a side wall of lighting device 372. A fastener 452, such as a threaded fastener, is adapted to extend through aperture 448 and to be threadably coupled to a side wall of lighting device 372. Tightening of fasteners 450 and 452 clamps clamp 430 into engagement with isolator member 388, such that clamp 430 clamps isolator member 388 adjacent to a side wall of lighting device 372. Clamp 430 may be made from metal or a hard plastic material.

Figure 29B:
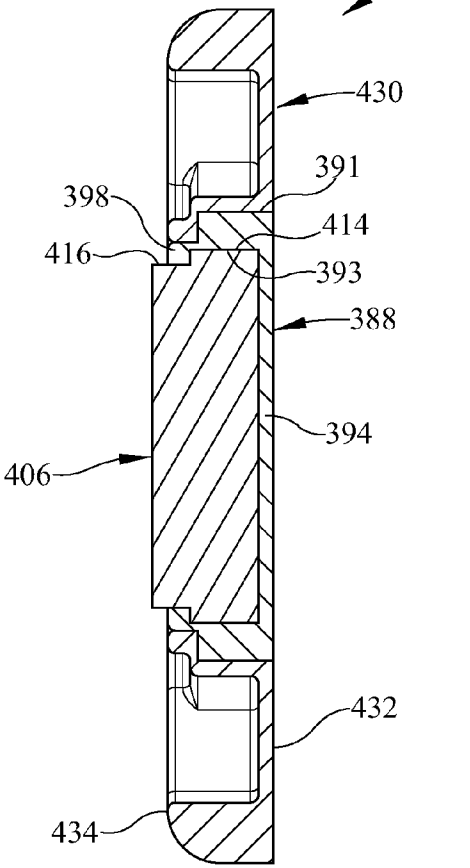
FIG. 29B is a cross-sectional view of the vibration isolating mounting device taken along line 29B-29B of FIG. 29A.
Figure 29A:
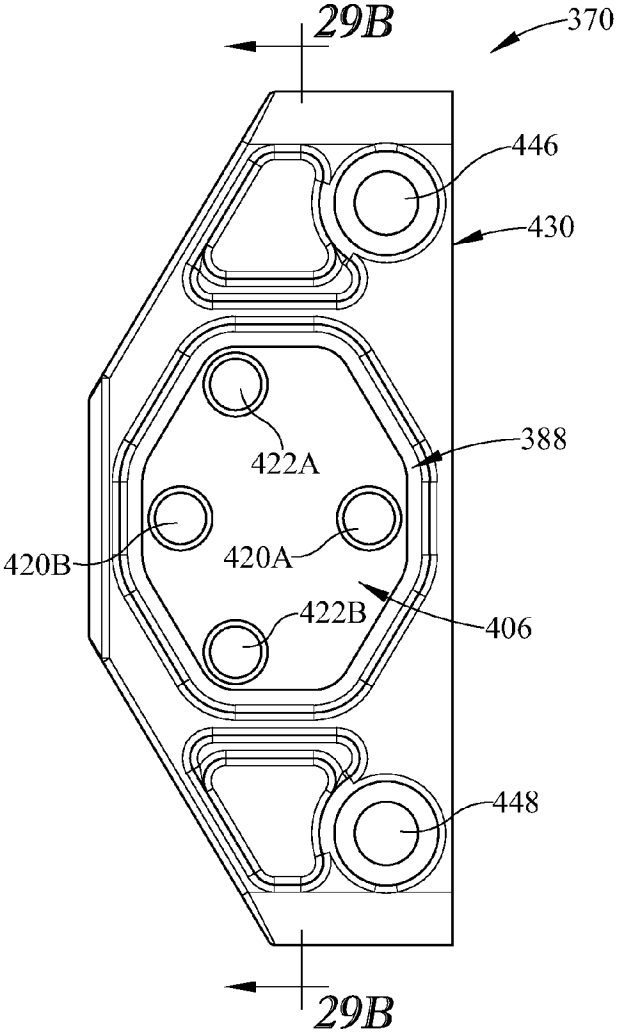
FIG. 29A is a side elevational view of the vibration isolating mounting device.

As shown in FIG. 29B, outer wall 414 and inner wall 416 of core member 406 compress side wall 390 of isolator member 388 against outer wall 440 and inner wall 442 of clamp 430. Isolator members 388 of mounting devices 370 will prevent or inhibit the transfer vibrations from mounting apparatus 20 or 170 and core member 406 to clamp 430 and lighting device 372 to thereby protect lighting device 372 from vibration.

Figure 30:
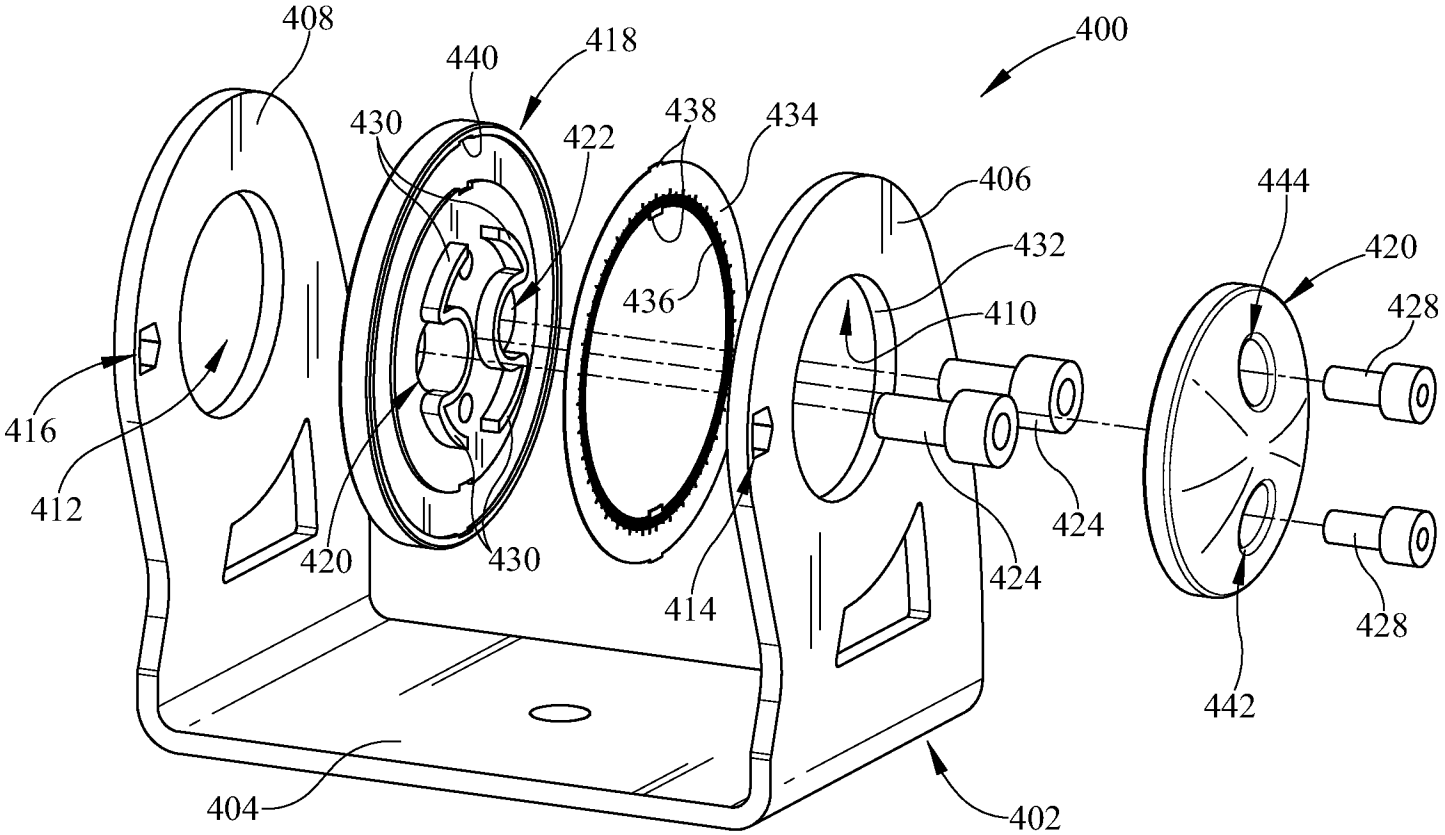
FIG. 30 is an exploded view of another embodiment of the isolated mounting device.

FIG. 30 shows a mounting apparatus 400 adapted to secure lighting device 22 to a vehicle. Mounting apparatus 400 includes mounting bracket 402 having a base 404 and upstanding ears 406, 408. Each ear includes a central aperture 410, 412 and an indicator window 414, 416.

Mounting apparatus 400 also includes an indexing plate 418 and a front plate 420. Mounting apparatus 400 includes two indexing plates 418 and two front plates 420, one pair per ear 406, 408. Indexing plate 418 includes a first pair of apertures 420, 422 that accept fasteners 424 to secure indexing plate 418 to lighting device 22. Indexing plate 418 also includes a second pair of apertures 424, 426 that accept fasteners 428.

Indexing plate 418 further includes flanges 430 that are configured to engage and slide against side wall 432 of aperture 410. Indicia ring 434 is configured to be coupled to indexing plate 418 and includes indicia 436 that is visible through indicator window 414. Indicia ring 434 includes tabs 438 that are adapted to be positioned within notches 440 of indexing plate 418. Front plate 420 is adapted to be positioned adjacent ear 406 and includes apertures 442 and 444 that accept fasteners 428. Mounting apparatus 400 allows for 360 degrees of adjustability to allow lighting device 22 to be oriented in any desired position.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A mounting apparatus for adjustably positioning a lighting device, said mounting apparatus comprising:

a mounting bracket having an ear, a first indicator associated with said ear of said mounting bracket;

a second indicator adapted to be coupled to the lighting device, said second indicator being rotationally coupled to said ear such that said second indicator and the lighting device are selectively conjointly rotatable about a rotational axis with respect to said mounting bracket and said first indicator;

whereby said second indicator and the lighting device may be selectively rotated about said rotational axis such that said second indicator is located in a desired position with respect to said first indicator whereby the lighting device is located in a desired measured orientation with respect to said mounting bracket; and wherein said first indicator comprises a plurality of visual indicia, and said second indicator comprises a pointer adapted to point to a selected indicia of ad first indicator.

2. The mounting apparatus of claim 1 wherein said plurality of visual indicia comprise markings on said ear.

3. The mounting apparatus of claim 1 wherein said plurality of visual indicia comprise a scale of degree markings for indicating the rotational position of said second indicator and the lighting device about said rotational axis with respect to said mounting bracket.

4. The mounting apparatus of claim 1 wherein said plurality of visual indicia comprise markings applied to said second indicator.

5. The mounting apparatus of claim 4 wherein said plurality of visual indicia comprise a scale of degree markings for indicating the rotational position of said second indicator and the lighting device about said rotational axis with respect to said mounting bracket.

6. The mounting apparatus of claim 1 including a locking member adapted to releasably retain said second indicator and the lighting device in a desired rotational position with respect to said mounting bracket and said first indicator.

7. The mounting apparatus of claim 1 wherein said mounting bracket includes a base, said base including a plurality of visual indicia for indicating the rotational position of the mounting bracket about an axis generally perpendicular to said rotational axis.

8. A mounting apparatus for adjustably positioning a lighting device, said mounting apparatus comprising:

a mounting bracket having an ear, said ear including an aperture;

a first indicator coupled to said ear of said mounting bracket, said first indicator comprising a plurality of visual indicia;

a trunnion including a hub located within said aperture of said ear of said mounting bracket, a flange extending outwardly from said hub, and a second indicator located adjacent said first indicator, said hub of said trunnion adapted to be attached to the lighting device such that said trunnion and the lighting device are selectively conjointly rotatable about a rotational axis with respect to said first indicator member and said mounting bracket;

whereby said second indicator of said trunnion and the lighting device can be selectively rotated about said rotational axis to locate said second indicator at a desired measured position with respect to said visual indicia of said first indicator such that the lighting device is located in a desired orientation with respect to said mounting bracket.

9. The mounting apparatus of claim 8 including a clamping member adapted to releasably clamp said flange of said trunnion between said ear of said mounting bracket and said clamping member.

10. The mounting apparatus of claim 9 including one or more locking members coupling said clamping member to said ear of said mounting bracket, each said locking member adapted to selectively move said clamping member along said rotational axis from an unlocked position toward said ear of said mounting bracket to a locked position and thereby clamp said flange of said trunnion between said clamping member and said ear to inhibit rotation of said trunnion and the lighting device with respect to said mounting bracket.

11. The mounting apparatus of claim 10 wherein said flange of said trunnion includes one or more arcuate slots, each said locking member extending through a respective slot of said flange such that said trunnion is rotatable about said rotational axis with respect to said locking members.

12. The mounting apparatus of claim 8 wherein said hub of said trunnion is formed from an elastomeric material such that said hub is adapted to inhibit the transmission of vibrations from said mounting bracket to the lighting device.

13. The mounting apparatus of claim 9 wherein said hub of said trunnion includes a first boss and a second boss located on opposite sides of said hub, said first boss located within said aperture of said ear of said mounting bracket, said clamping member including an aperture adapted to receive said second boss of said hub, such that said first boss is rotatable within said aperture of said ear and said second boss is rotatable within said aperture of said clamping member.

14. The mounting apparatus of claim 8 wherein said second indicator includes a pointer that extends outwardly from said hub such that said pointer overlies said ear of said mounting bracket, said ear being located between said flange and said pointer of said trunnion.

15. The mounting apparatus of claim 10 wherein each said locking member comprises a fastener.

16. A mounting apparatus for adjustably positioning a lighting device, said mounting device comprising:

a mounting bracket having an ear, said ear including a first indicator;

a second indicator comprising a plurality of visual indicia, said second indicator adapted to be coupled to the lighting device and rotationally coupled to said ear such that said second indicator and the lighting device are conjointly rotatable with respect to said ear of said mounting bracket about a rotational axis;

whereby said second indicator and the lighting device can be selectively rotated about said rotational axis to locate said second indicator at a desired location with respect to said first indicator such that the lighting device is located in a desired measured orientation with respect to said mounting bracket;

wherein said ear includes an elongate slot and the mounting apparatus includes a locking member adapted to releasably clamp said second indicator between the lighting device and said ear to inhibit rotation of the lighting device and said second indicator with respect to said mounting bracket, said locking member extending through said slot in said ear and being selectively positionable along the length of said slot as the lighting device and said second indicator are rotated about said rotational axis;

said ear also including an aperture aligned with said rotational axis, and a pivot member extending through said aperture of said ear and through said second indicator, and adapted to be coupled to the lighting device, said pivot member adapted to rotationally couple the lighting device to said ear of said mounting bracket and said pivot member comprises a locking member adapted to releasably clamp said second indicator between the lighting device and said car of said mounting bracket to inhibit rotational movement of the lighting device and the second indicator member with respect to said mounting bracket.

17. The mounting apparatus of claim 16 including a first elastomeric pad, a clamping member, a first locking member and a second locking member, said first locking member and said second locking member adapted to releasably clamp said first pad between said clamping member and said ear of said mounting bracket to inhibit rotational movement of said second indicator and the lighting device with respect to the mounting bracket.

18. The mounting apparatus of claim 17 wherein said first locking member and said second locking member each extend through said clamping member, said first pad and said second indicator such that said clamping member, said first pad and said second indicator are conjointly rotatable about said rotational axis with respect to said ear of said mounting bracket.

19. The mounting apparatus of claim 17 including a second elastomeric pad located between said second indicator and the lighting device, said first and second pads adapted to inhibit the transmission of vibrations from said ear of said mounting bracket to the lighting device.

20. The mounting apparatus of claim 16 wherein said first indicator comprises an aperture in said ear, said aperture forming a pointer and overlying said second indicator such that one or more of said visual indicia of said second indicator is viewable through said aperture of said first indicator.

21. A vibration isolating mounting device for mounting a lighting device to a mounting apparatus, said mounting device comprising:

a vibration isolator member having a peripheral edge and an aperture located within said peripheral edge, said vibration isolator member being formed from a vibration absorbing material;

a core member located in said aperture of said isolator member and coupled to said isolator member, said core member adapted to be coupled to the mounting apparatus; and a clamp having an opening adapted to receive said isolator member such that said isolator member is coupled to said clamp, said clamp adapted to couple said isolator member to the lighting device;

whereby said isolator member is adapted to reduce the transmission of vibrations from the mounting apparatus and core member to said clamp and the lighting device.

22. The mounting device of claim 21 wherein said vibration absorbing material of said isolator member comprises an elastomeric material.

23. The mounting device of claim 21 wherein said clamp is generally C-shaped and includes a groove extending along said aperture of said clamp, said groove adapted to receive said isolator member.

24. The mounting device of claim 23 wherein said isolator member includes an outwardly extending rib, said rib adapted to be received in said groove of said clamp.

* * * * *

UNITED STATES PATENT AND TRADEMARK OFFICE

CERTIFICATE OF CORRECTION

PATENT NO. : 8,960,976 B2
APPLICATION NO. : 13/693170
DATED : February 24, 2015
INVENTOR(S) : Anthony C. Georgitsis et al.

It is certified that error appears in the above-identified patent and that said Letters Patent is hereby corrected as shown below:

In the Claims col. 14, line 19, delete the word "ad" and insert in its place the word --said--.

Signed and Sealed this
Thirtieth Day of June, 2015

Michelle K. Lee

Michelle K. Lee
*Director of the United States Patent and Trademark Office*